US010493755B2

(12) United States Patent
Nozawa

(10) Patent No.: US 10,493,755 B2
(45) **Date of Patent: *Dec. 3, 2019**

(54) DRIVING CIRCUIT FOR CAPACITIVE LOAD

(71) Applicant: Seiko Epson Corporation, Tokyo (JP)

(72) Inventor: Dai Nozawa, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/208,970

(22) Filed: Dec. 4, 2018

(65) Prior Publication Data

US 2019/0105896 A1 Apr. 11, 2019

Related U.S. Application Data

(62) Division of application No. 15/277,127, filed on Sep. 27, 2016, now Pat. No. 10,179,449.

(30) Foreign Application Priority Data

Oct. 9, 2015 (JP) ..... 2015-200825

(51) Int. Cl.
*B41J 2/045* (2006.01)

(52) U.S. Cl.
CPC ..... *B41J 2/04541* (2013.01); *B41J 2/04581* (2013.01); *B41J 2/04588* (2013.01); *B41J 2/04593* (2013.01); *B41J 2/04596* (2013.01)

(58) Field of Classification Search
CPC ..... B41J 2/04541; B41J 2/04588; B41J 2/04593; B41J 2/04596; B41J 2/04581
See application file for complete search history.

(56) References Cited

U.S. PATENT DOCUMENTS

| | | | | |
|---|---|---|---|---|
| 6,504,227 | B1 | 1/2003 | Matsuo et al. | |
| 10,179,449 | B2 * | 1/2019 | Nozawa | B41J 2/04588 |
| 2003/0067052 | A1 | 4/2003 | Matsuo et al. | |
| 2003/0137818 | A1 | 7/2003 | Chou | |
| 2003/0148739 | A1 * | 8/2003 | Kosemura | H01F 17/0006 455/73 |
| 2007/0175545 | A1 | 8/2007 | Urata et al. | |

(Continued)

FOREIGN PATENT DOCUMENTS

| | | | |
|---|---|---|---|
| JP | 2001-077315 | A | 3/2001 |
| JP | 2001-308538 | A | 11/2001 |

(Continued)

*Primary Examiner* — Yaovi M Ameh

(57) ABSTRACT

A driving circuit for a capacitive load comprises: a demodulator including an inductor; a circuit board supporting the demodulator; and wiring patterns on the circuit board. The wiring patterns include first and second wiring patterns that are separated from each other. In the inductor, a coil and a core are integrally formed and are mounted on the circuit board so that an axial direction of the core around which the coil is wound intersects the circuit board, and part of the core is directly exposed to the circuit board. The first wiring pattern is electrically connected to a first terminal of the coil. The second wiring pattern is electrically connected to a second terminal of the coil. The first and second wiring patterns do not extend between the coil and the circuit board, and also do not extend between the core and the circuit board.

5 Claims, 15 Drawing Sheets

(56) References Cited

U.S. PATENT DOCUMENTS

| | | | | |
|---|---|---|---|---|
| 2010/0079520 | A1 | 4/2010 | Hiwada | |
| 2013/0223033 | A1 | 8/2013 | Mano et al. | |
| 2014/0285579 | A1 | 9/2014 | Oshima et al. | |
| 2014/0354526 | A1* | 12/2014 | Kang | H01F 27/29 345/102 |
| 2015/0145911 | A1 | 5/2015 | Kashimura et al. | |
| 2015/0246532 | A1 | 9/2015 | Abe et al. | |
| 2016/0243824 | A1 | 8/2016 | Abe et al. | |
| 2016/0355015 | A1 | 12/2016 | Kashimura et al. | |
| 2017/0294254 | A1 | 10/2017 | Urata et al. | |

FOREIGN PATENT DOCUMENTS

| | | | |
|---|---|---|---|
| JP | 2002-334806 | A | 11/2002 |
| JP | 2004-297384 | A | 10/2004 |
| JP | 2007-231415 | A | 9/2007 |
| JP | 2010-034102 | A | 2/2010 |
| JP | 2010-114711 | A | 5/2010 |
| JP | 2015-101056 | A | 6/2015 |
| JP | 2015-164783 | A | 9/2015 |

* cited by examiner

<DECODING CONTENTS OF DECODER>

| PRINTING DATA Data | T1 | | T2 | |
|---|---|---|---|---|
| | Sa | Sb | Sa | Sb |
| (1, 1) | H | L | H | L |
| (0, 1) | H | L | L | H |
| (1, 0) | L | L | L | H |
| (0, 0) | L | H | L | L |

MSB LSB

<WIRING PATTERN>

<DISPOSING OF ELEMENTS (RELATIONSHIP WITH WIRING PATTERN)>

<WIRING PATTERN>

<WIRING PATTERN (COMPARISON EXAMPLE)>

<DISPOSING OF ELEMENTS(COMPARISON EXAMPLE)>

DRIVING CIRCUIT FOR CAPACITIVE LOAD

CROSS-REFERENCE TO RELATED APPLICATIONS

This application is a divisional of U.S. patent application Ser. No. 15/277,127, filed Sep. 27, 2016, and claims priority to Japanese Patent Application No. 2015-200825, filed Oct. 9, 2015, both of which are hereby expressly incorporated by reference herein in their entireties.

BACKGROUND

1. Technical Field

The present invention relates to a liquid ejecting apparatus and a head unit.

2. Related Art

As an ink jet printer which prints an image or a document by ejecting ink, a printer in which a piezoelectric element is used has been known. The piezoelectric elements are provided corresponding to respective plurality of nozzles in a head unit, and form dots when ink (liquid) of a predetermined amount is ejected from the nozzle at a predetermined timing, by being respectively driven according to a driving signal. Since the piezoelectric element is a capacitive load such as a capacitor in an electrical view, it is necessary to supply sufficient currents in order to operate the piezoelectric element in each nozzle.

For this reason, it is a configuration in which a piezoelectric element is driven, by amplifying a source signal using an amplifying circuit, and supplying the signal to a head unit as a driving signal. For the amplifying circuit, there is a method in which a source signal before being amplified is subjected to current amplification using class AB amplification, or the like; however, since energy efficiency is not good, class D amplification has been proposed in recent years (refer to JP-A-2010-114711). In the class D amplification, plainly speaking, an input signal is amplified by performing pulse width modulation or pulse density modulation with respect to a source signal, switching a high side transistor and a low side transistor which are inserted in series between power supply voltages according to the modulated signal, and by demodulating an amplified-modulated signal which is obtained by performing switching, using a low pass filter (demodulator) which includes an inductor (coil) and a capacitor.

Meanwhile, in order to cause a piezoelectric element to eject ink using a driving signal which is amplified using class D amplification, it is necessary to increase a frequency of a modulated signal to some extent. However, when switching the high side transistor and the low side transistor according to a modulated signal with a frequency which is relatively high, there is a problem in that operations thereof become unstable due to an influence of noise, or the like.

SUMMARY

An advantage of some aspects of the invention is to provide a technology for stabilizing operations in a liquid ejecting apparatus in which a driving signal applied to a piezoelectric element is subjected to class D amplification.

According to an aspect of the invention, there is provided a liquid ejecting apparatus which includes a modulation circuit which generates a modulated signal obtained by performing pulse modulation with respect to a source signal as a source of a driving signal; an amplifier which generates an amplified-modulated signal by amplifying the modulated signal; a demodulator which includes an inductor and a capacitor, and generates a driving signal by smoothing the amplified-modulated signal; a circuit board on which the modulation circuit, the amplifier, and the demodulator are mounted, and a plurality of wiring patterns are formed on the surface; a piezoelectric element which is deformed by being applied with the driving signal; a cavity of which an internal volume is changed due to deforming of the piezoelectric element, when being filled with liquid in the inside; and a nozzle which is provided in order to eject liquid in the inside of the cavity, according to a change in an internal volume of the cavity, in which, in the inductor, a coil and a core are integrally formed, and are mounted so that an axial direction of the core around which the coil is wound intersects the circuit board, and the wiring pattern is not formed in a region which intersects the axial direction of the core, on the circuit board.

In a case in which the inductor is mounted so that the axial direction of the core intersects the circuit board, when a wiring pattern is provided in the region on the circuit board which intersects the axial direction of the core, an eddy current due to a leakage flux is generated in the wiring pattern, and causes inconvenience such as unstableness in an oscillating frequency or deterioration in power consumption. For this reason, it is possible to avoid such inconvenience by not forming a wiring pattern in the region which intersects the axial direction of the core, on the circuit board.

According to the aspect, it is possible to improve stability of the oscillating frequency in the circuit by reducing an interference in a signal due to the leakage flux, generate a driving signal with good accuracy, and to reduce erroneous ejecting of liquid. In addition, it is also possible to reduce power consumption in the circuit.

Such an effect also can be obtained in a configuration in which the wiring pattern formed in the region intersecting the axial direction of the core is set so as not to be electrically connected to another wiring pattern which is formed in another region, on the circuit board.

The source signal is a signal as a source of a driving signal which regulates a displacement of a piezoelectric element, that is, a signal before modulating, and a signal as a reference of a waveform of a driving signal (regardless of analog or digital, including signal for regulating). A modulated signal is a digital signal which is obtained by performing pulse modulation with respect to the source signal (for example, pulse width modulation, pulse density modulation, or the like).

In the liquid ejecting apparatus, it is preferable that the circuit board includes a first terminal which is electrically connected to one electrode of the inductor, and a second terminal which is electrically connected to the other electrode of the inductor, and the wiring pattern is not formed between the first terminal and the second terminal. That is, the wiring pattern may not be formed between the first terminal and the second terminal.

In the liquid ejecting apparatus, a through hole may be formed in at least one of a wiring pattern which is connected to the first terminal and a wiring pattern which is connected to the second terminal.

Since the inductor is a part of the demodulator which demodulates the amplified-modulated signal, a relatively large current flows therein, and the inductor easily generates heat. It is possible to increase heat radiating efficiency, since it is possible to cause heat generated in the inductor to be radiated to a separate wiring pattern through a through hole, by providing the through hole in this manner.

In the liquid ejecting apparatus, it is preferable that components other than the core and the circuit board are not provided between the core and the circuit board. Since other components are not provided between the core and the circuit board, it is possible to miniaturize the circuit.

Meanwhile, in the liquid ejecting apparatus according to the aspect, liquid is ejected from the nozzle, when a driving signal is generated by smoothing an amplified-modulated signal, and a piezoelectric element is displaced, by applying the driving signal. Here, when the liquid ejecting apparatus analyzes a waveform of the driving signal for ejecting a small dot, for example, using a frequency spectrum, it is understood that a frequency component of 50 KHz or more is included. In order to generate a driving signal including the frequency component of 50 KHz or more, it is necessary to set a frequency of a modulated signal to 1 MHz or more.

Here, if a frequency of a modulated signal is set to be lower than 1 MHz, an edge of a waveform of a driving signal which is reproduced becomes dull and round. In other words, a rough edge is smoothed down, and the waveform becomes dull. When the waveform of the driving signal becomes dull, a displacement of a piezoelectric element which is operated according to rising and falling edges of a waveform becomes moderate, tailing at a time of ejecting, an ejecting failure, or the like, occurs, and a printing quality deteriorates.

Meanwhile, when a frequency of the modulated signal is set to be higher than 8 MHz, a resolving power of a waveform of the driving signal becomes high. However, a switching loss becomes large when a switching frequency in a transistor increases, and a power saving performance, and a performance of saving heat generation which are superior to linear amplification such as class AB amplification deteriorate.

In the liquid ejecting apparatus according to the aspect, it is preferable to set a frequency of the modulated signal to 1 MHz or more and 8 MHz or less.

The invention can be executed in various aspects, and in various aspects such as a single body of a head unit, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment for executing the invention will be described with reference to drawings.

A printing apparatus according to the embodiment is an ink jet printer (liquid ejecting apparatus) which forms an ink dot group on a medium such as paper, by causing ink to be ejected according to image data which is supplied from an external host computer, and prints an image (including characters, figures, or the like) corresponding to the image data using the ink dot group.

Figure 1:
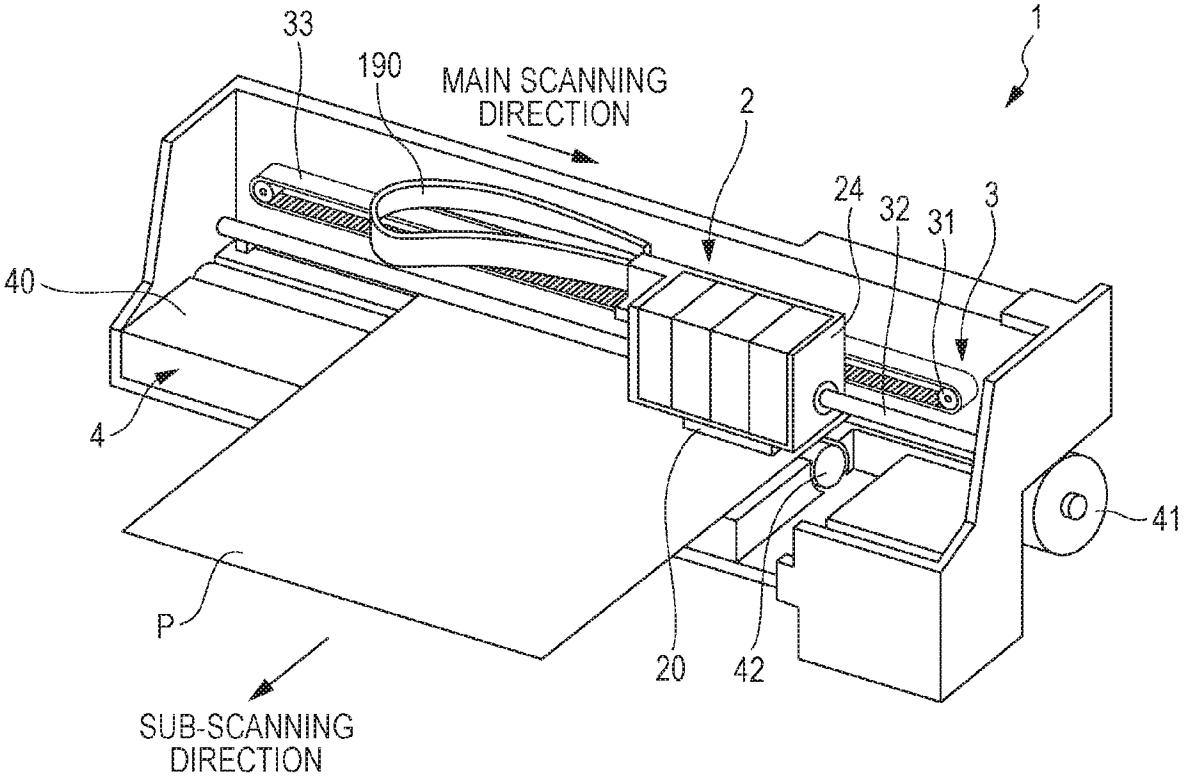
FIG. 1 is a diagram which illustrates a schematic configuration of a printing apparatus.

FIG. 1 is a perspective view which illustrates a schematic configuration of the inside of the printing apparatus.

As illustrated in the figure, a printing apparatus is provided with a movement mechanism 3 which causes a moving object 2 to move (reciprocating) in a main scanning direction.

The movement mechanism 3 includes a carriage motor 31 as a driving source of the moving object 2, a carriage guiding shaft 32 of which both ends are fixed, and a timing belt 33 which extends approximately in parallel to the carriage guiding shaft 32, and is driven by the carriage motor 31.

A carriage 24 of the moving object 2 is supported by the carriage guiding shaft 32 so as to reciprocate, and is fixed to a part of the timing belt 33. For this reason, when the timing belt 33 is subjected to forward-reverse driving by the carriage motor 31, the moving object 2 is guided by the carriage guiding shaft 32, and reciprocates.

A head unit 20 is provided at a portion of the moving object 2 which faces a medium P. As described later, the head unit 20 causes ink droplets (liquid droplets) to be ejected from a plurality of nozzles, and has a configuration in which various control signals are supplied through a flexible cable 190.

The printing apparatus 1 includes a transport mechanism 4 which transports a medium P in the sub-scanning direction on the platen 40. The transport mechanism 4 is provided with a transport motor 41 as a driving source, and a transport roller 42 which transports the medium P in the sub-scanning direction by being rotated by the transport motor 41.

An image is formed on the surface of the medium P, when a head unit 20 ejects ink droplets onto the medium P at a timing in which the medium P is transported by the transport mechanism 4.

Figure 2:
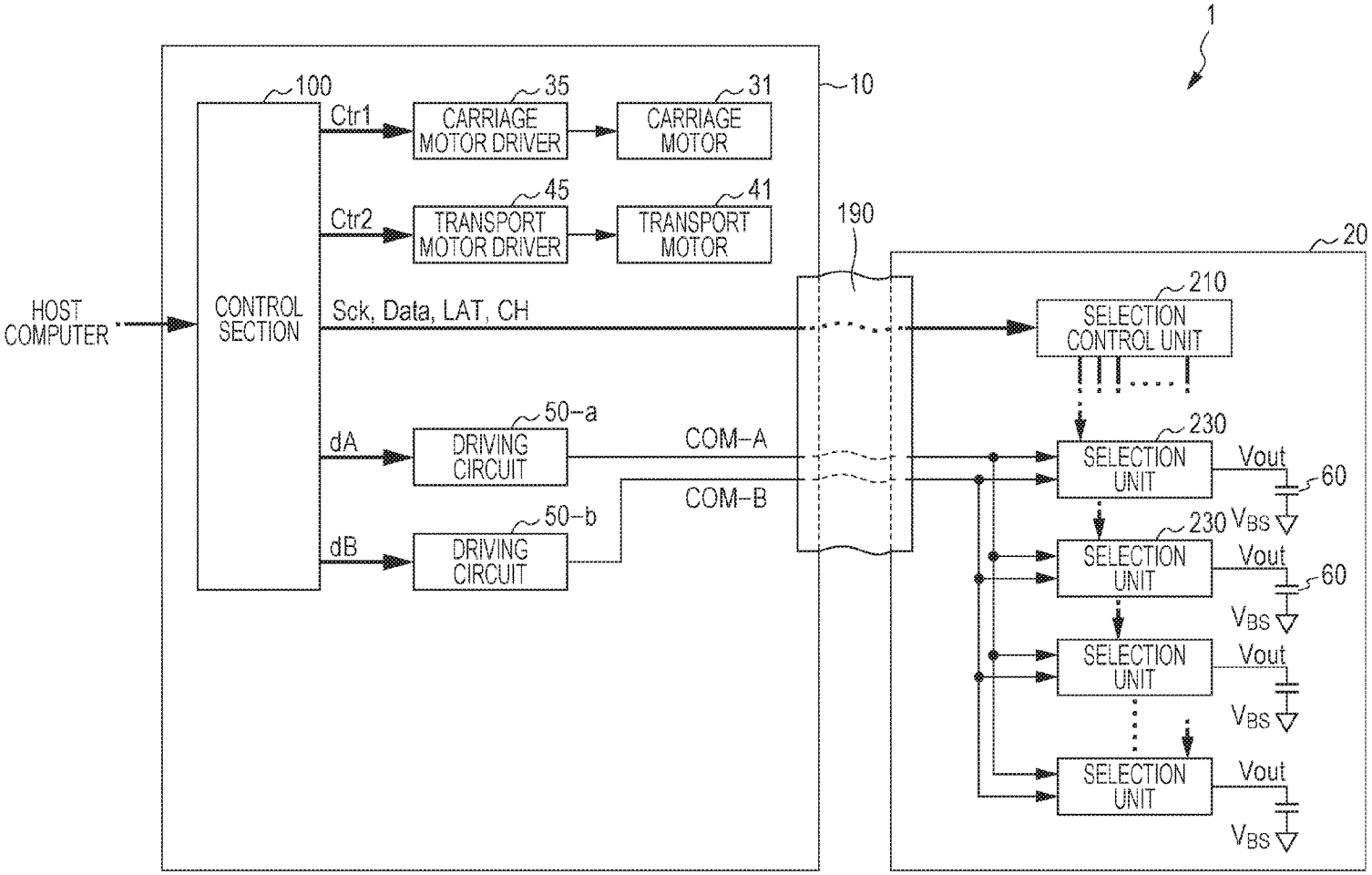
FIG. 2 is a block diagram which illustrates a configuration of the printing apparatus.

FIG. 2 is a block diagram which illustrates an electrical configuration of the printing apparatus.

As illustrated in the figure, in the printing apparatus 1, a control unit 10 and the head unit 20 are connected through a flexible cable 190.

The control unit 10 includes a control section 100, a carriage motor 31, a carriage motor driver 35, the transport motor 41, a transport motor driver 45, two driving circuits 50-*a* and 50-*b*, and the head unit 20. Among these, the control section 100 outputs various control signals for controlling each unit, when image data is supplied from the host computer.

In detail, first, the control section 100 supplies a control signal Ctr1 to the carriage motor driver 35, and the carriage motor driver 35 drives the carriage motor 31 according to the control signal Ctr1. In this manner, a movement in a carriage 24 is controlled.

Secondly, the control section 100 supplies a control signal Ctr2 to the transport motor driver 45, and the transport motor driver 45 drives the transport motor 41 according to the control signal Ctr2. In this manner, a movement in the sub-scanning direction using the transport mechanism 4 is controlled.

Thirdly, the control section 100 supplies digital data dA to one driving circuit 50-*a* in the two driving circuits 50-*a* and 50-*b*, and supplies digital data dB to the other driving circuit 50-*b*. Here, the data dA regulates a waveform of a driving signal COM-A in driving signals which are supplied to the head unit 20, and the data dB regulates a waveform of a driving signal COM-B.

In addition, though it will be described in detail later, the driving circuits 50-*a* performs an analog conversion with respect to the data dA, and supplies the driving signal COM-A which is subjected to the class D amplification to the head unit 20 thereafter. Similarly, the driving circuit 50-*b* performs an analog conversion with respect to the data dB, and supplies the driving signal COM-B which is subjected to the class D amplification to the head unit 20 thereafter. In addition, in the driving circuits 50-*a* and 50-*b*, only the data which is input, and the driving signal which is output are different, and as will be described later, circuit configurations are the same as each other. For this reason, in a case in which it is not necessary to particularly distinguish the driving circuits 50-*a* and 50-*b* (for example, in case of describing FIG. 10 which will be described later), the driving circuits will be described by giving a reference numeral of "50", simply, by omitting "- (hyphen)" and thereafter.

Fourthly, the control section 100 supplies a clock signal Sck, a data signal Data, control signals LAT and CH to the head unit 20.

A selection control unit 210, and a plurality sets of selecting units 230 and piezoelectric elements 60 are provided in the head unit 20.

The selection control unit 210 instructs whether to select the driving signal COM-A or the driving signal COM-B (or to select neither of signals) using a control signal, or the like, which is supplied from the control section 100 with respect to the respective selecting units 230, and the selecting unit 230 selects the driving signal COM-A or the driving signal COM-B according to the instruction of the selection control unit 210, and supplies the signal to respective one ends of the piezoelectric elements 60 as a driving signal. In the figure, a voltage of the driving signal which is applied to one end of the piezoelectric element 60 is denoted by Vout.

The other end of the respective piezoelectric elements 60 is commonly applied with a voltage VBS.

The piezoelectric element 60 is provided corresponding to a respective plurality of nozzles in the head unit 20. In addition, the piezoelectric element 60 causes ink to be ejected by being displaced according to a difference between the voltage Vout and the voltage VBS of a driving signal which is selected by the selecting unit 230. Therefore, subsequently, a configuration in which ink is ejected due to driving with respect to the piezoelectric element 60 will be simply described.

Figure 3:
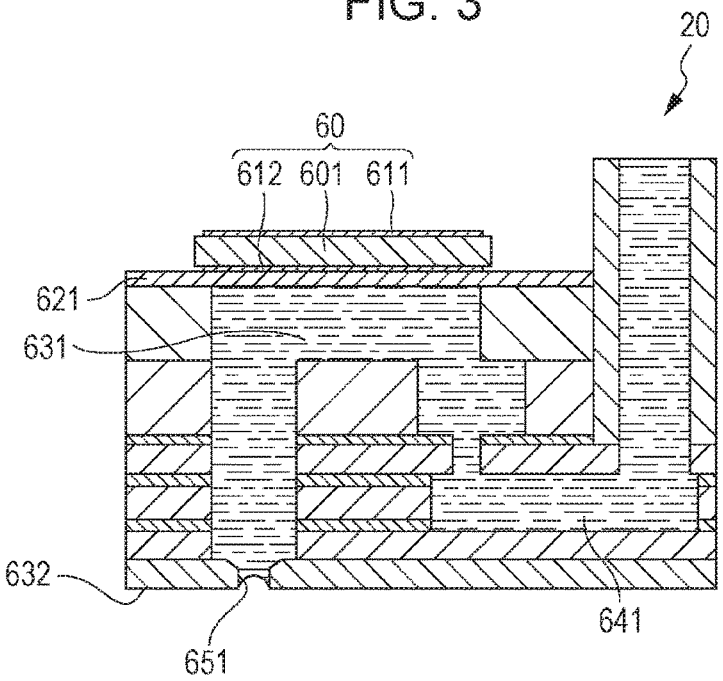
FIG. 3 is a diagram which illustrates a configuration of an ejecting unit in a head unit.

FIG. 3 is a diagram which illustrates a schematic configuration of the ejecting unit corresponding to one nozzle in the head unit 20.

As illustrated in the figure, the ejecting unit in the head unit 20 includes the piezoelectric element 60, a vibrating plate 621, a cavity (pressure chamber) 631, a reservoir 641, and a nozzle 651. Among these, the vibrating plate 621 is displaced (bending vibration) due to the piezoelectric element 60 which is provided on a top face in the figure, and functions as a diaphragm which enlarges or contracts an internal volume of the cavity 631 which is filled with ink. The nozzle 651 is an opening hole portion which is provided in a nozzle plate 632, and communicates with the cavity 631.

The piezoelectric element 60 illustrated in the figure has a structure in which a piezoelectric substance 601 is interposed between a pair of electrodes 611 and 612. In the piezoelectric substance 601 with the structure, a center portion in the figure bends in the vertical direction with respect to both end portions along with the electrodes 611 and 612, and the vibrating plate 621 according to a voltage applied by the electrodes 611 and 612. Specifically, the piezoelectric element 60 bends upward when a voltage Vout of a driving signal increases, and on the other hand, bends downward when the voltage Vout decreases. In this configuration, when the piezoelectric element bends upward, ink is drawn into the cavity from the reservoir 641, since the internal volume of the cavity 631 enlarges, and on the other hand, when the piezoelectric element bends downward, since the internal volume of the cavity 631 contracts, ink is ejected from the nozzle 651 depending on a degree of the contraction.

The piezoelectric element 60 may be a type which can cause liquid such as ink to be ejected by deforming the piezoelectric element 60, without being limited to the illustrated structure. In addition, the piezoelectric element 60 may have a configuration in which a so-called vertical vibration is used, without being limited to bending vibration.

The piezoelectric element 60 is provided corresponding to the cavity 631 and the nozzle 651 in the head unit 20, and the piezoelectric element 60 is provided also corresponding to the selecting unit 230 in FIG. 2. For this reason, a set of the piezoelectric element 60, the cavity 631, the nozzle 651, and the selecting unit 230 configures the ejecting unit which is provided in each nozzle 651.

Figure 4A:
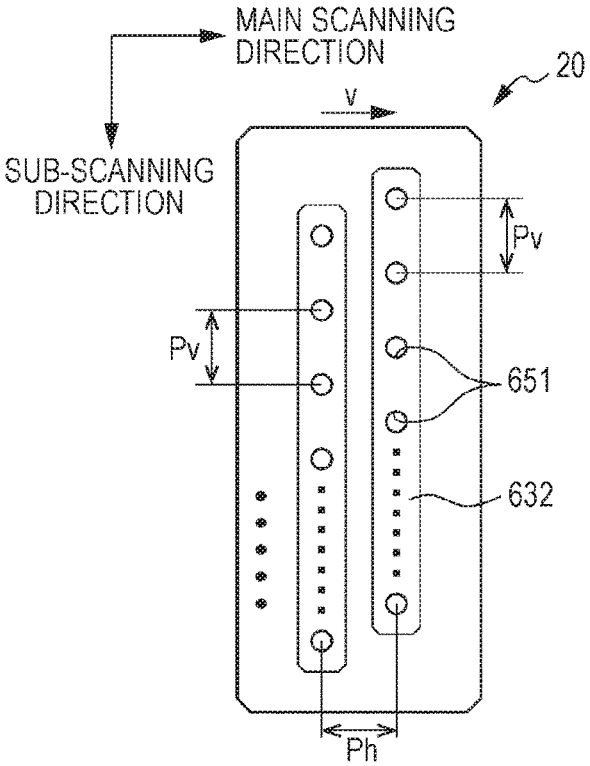
FIG. 4A is a diagram which illustrates a nozzle arrangement in the head unit.

FIG. 4A is a diagram which illustrates an example of arrangement of the nozzles 651.

As illustrated in the figure, the nozzles 651 are arranged in two columns as described below, for example. Specifically, when viewing one column, a plurality of the nozzles 651 are arranged at a pitch Pv along the sub-scanning direction, and meanwhile, when viewing two columns, the nozzles are separated by a pitch Ph in the main scanning direction, and are in a relationship of being shifted by a half of the pitch Pv in the sub-scanning direction.

In a case of color printing, in the nozzle 651, patterns corresponding to each of colors of C (cyan), M (magenta), Y (yellow), K (black), and the like, are provided along the main scanning direction, for example; however, in the following descriptions, for simplification, a case in which gradation is expressed, using a single color will be described.

Figure 4B:
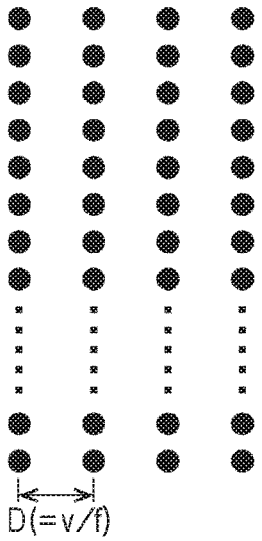
FIG. 4B is a diagram which describes dots which are formed by the nozzle arrangement.

FIG. 4B is a diagram which describes basic resolution of an image formation using a nozzle arrangement which is illustrated in FIG. 4A. The figure is an example of a method of forming one dot (first method) by causing ink droplets to be ejected once from the nozzle 651, in order to simplify descriptions, and black circles denote dots which are formed due to landing of ink droplets.

When the head unit 20 moves in the main scanning direction at a speed of v, as illustrated in the figure, an interval D (in main scanning direction) of dots which are formed due to landing of ink droplets, and the speed v are in the following relationship.

That is, in a case in which one dot is formed due to ejecting of ink of one time, the interval D of dots is denoted by a value (=v/f) which is obtained by dividing the speed v by an ink ejecting frequency f, in other words, a movement distance of the head unit 20 in a cycle (1/f) in which ink droplets are repeatedly ejected.

In the example in FIG. 4B, ink droplets which are ejected from the nozzles 651 of two columns are landed on the medium P so as to be aligned on the same column, in a relationship in which the pitch Ph is proportional to the interval D using a coefficient n. For this reason, as illustrated in FIG. 4B, a dot interval in the sub-scanning direction becomes a half of the dot interval in the main scanning direction. It is needless to say that the dot arrangement is not limited to the illustrated example.

Meanwhile, in order to execute high speed printing, the movement speed v of the head unit 20 in the main scanning direction may be increased, in a simple way. However, the interval D of dots becomes long merely by increasing the speed v. For this reason, in order to execute high speed printing after securing resolution to some extent, it is necessary to increase the number of dots which is formed per unit hour by increasing the ink ejecting frequency f.

In order to increase resolution, separately from printing speed, the number of dots which is formed per unit hour may be increased. However, when ink is not set to a small amount in a case of increasing the number of dots, not only adjacent dots are combined, but also printing speed decreases, when the ink ejecting frequency f is not increased.

In this manner, in order to execute high speed printing and high resolution printing, it is necessary to increase the ink ejecting frequency f, as described above.

Meanwhile, as a method of forming dot on the medium P, there is a method of forming one dot (second method) by combining one or more ink droplets which are landed, by causing the one or more ink droplets which are ejected in a unit period to land, or a method of forming two or more dots (third method) without combining the two or more ink droplets, by setting ink droplets to be ejected two times or more in a unit period, in addition to a method of forming one dot by causing ink droplets to be ejected once. In the following descriptions, a case in which dots are formed by using the second method will be described.

In the embodiment, the second method will be described by assuming the following example. That is, in the embodiment, one dot is expressed in four gradations of a large dot, a medium dot, a small dot, and non-recording by causing ink to be ejected two times at maximum. In order to express the four gradations, according to the embodiment, two types of driving signals of COM-A and COM-B are prepared, and the first half pattern and the second half pattern are provided in one cycle in each of the driving signals. A configuration in which the driving signal COM-A or COM-B is selected (or not selected) according to a gradation to be expressed, in the first half and the second half in one cycle, and is supplied to the piezoelectric element 60 is adopted.

Therefore, the driving signals COM-A and COM-B will be described, and a configuration for selecting the driving signal COM-A or COM-B will be described thereafter. The driving signals COM-A and COM-B are generated by the driving circuit 50, respectively, and for convenience, the driving circuit 50 will be described after describing the configuration for selecting the driving signal COM-A or COM-B.

Figure 5:
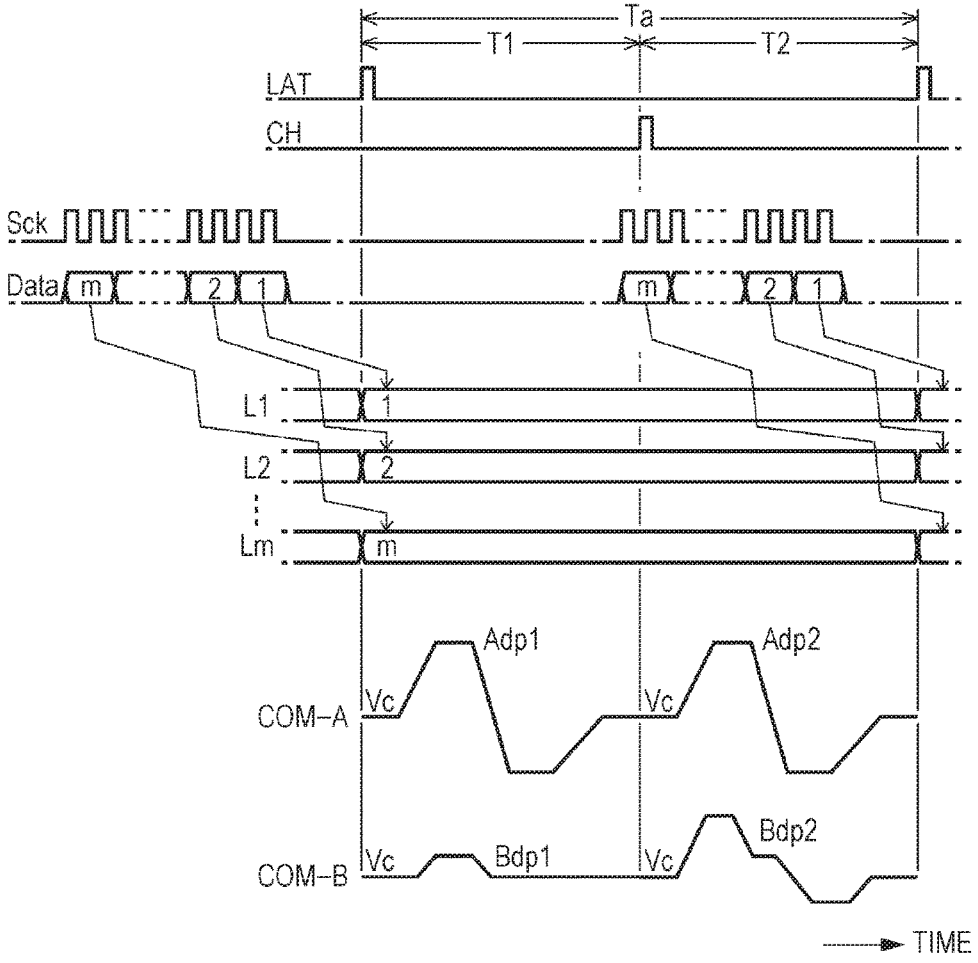
FIG. 5 is a diagram which describes an operation of a selection control unit in the head unit.

FIG. 5 is a diagram which illustrates waveforms of the driving signals COM-A and COM-B, or the like.

As illustrated in the figure, the driving signal COM-A is formed in a waveform in which a trapezoidal waveform Adp1 which is disposed in a period T1 from outputting (rising) of the control signal LAT to outputting of the control signal CH, in a printing period Ta, and a trapezoidal waveform Adp2 which is disposed in a period T2 from outputting of the control signal CH to outputting of the subsequent control signal LAT, in the printing period Ta are set to be continuous.

In the embodiment, the trapezoidal waveforms Adp1 and Adp2 are approximately the same waveform as each other, and when it is assumed that the respective waveforms are supplied to one end of the piezoelectric element 60, the trapezoidal waveforms are waveforms which causes ink of a predetermined amount, specifically, ink of a moderate amount to be ejected from nozzles 651 corresponding to the piezoelectric element 60, respectively.

The driving signal COM-B is formed in a waveform in which a trapezoidal waveform Bdp1 which is disposed in the period T1 and a trapezoidal waveform Bdp2 which is disposed in the period T2 are set to be continuous. In the embodiment, the trapezoidal waveforms Bdp1 and Bdp2 are different waveforms from each other. In these, the trapezoidal waveform Bdp1 is a waveform which prevents an increase in viscosity of ink by causing ink in the vicinity of the opening hole portion of the nozzle 651 to minutely vibrate. For this reason, even when the trapezoidal waveform Bdp1 is supplied to one end of the piezoelectric element 60, ink droplets are not ejected from the nozzle 651 corresponding to the piezoelectric element 60. The trapezoidal waveform Bdp2 is a waveform which is different from the trapezoidal waveform Adp1 (Adp2). The trapezoidal waveform is a waveform which causes ink of an amount smaller than the above described predetermined amount to be ejected from a nozzle 651 corresponding to the piezoelectric element 60, when it is assumed that the trapezoidal waveform Bdp2 is supplied to one end of the piezoelectric element 60.

Both a voltage at a start timing and a voltage at an ending timing of the trapezoidal waveforms Adp1, Adp2, Bdp1, and Bdp2 are a voltage Vc, and common. That is, the trapezoidal waveforms Adp1, Adp2, Bdp1, and Bdp2 are waveforms which start in the voltage Vc, and end in the voltage Vc, respectively.

Figures 6, 7:
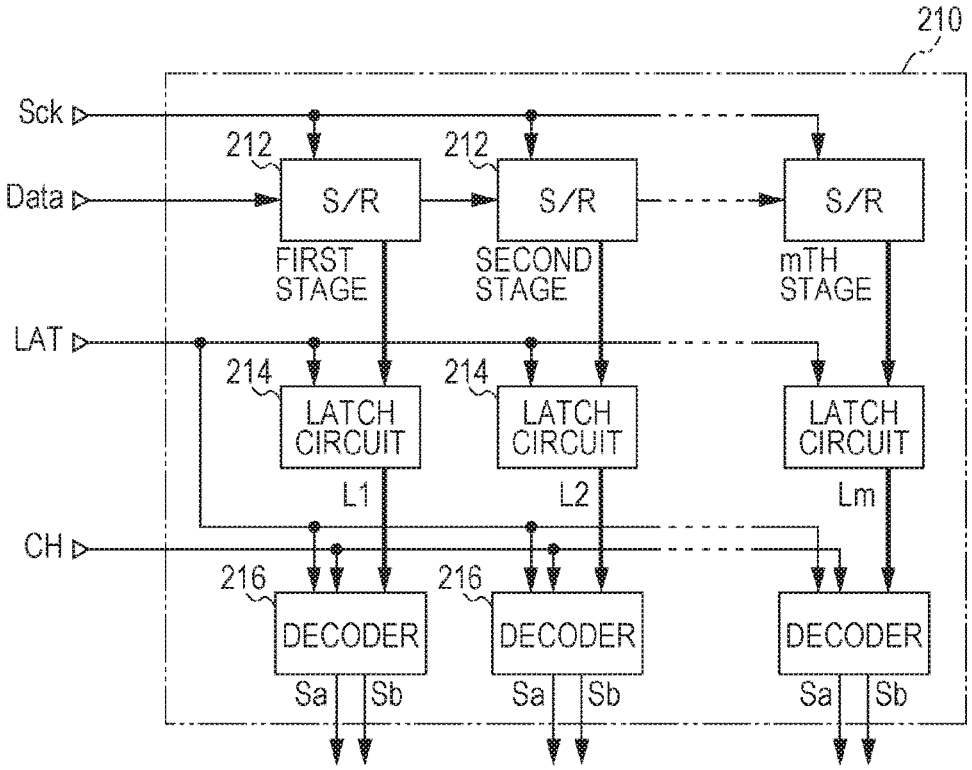
FIG. 6 is a diagram which illustrates a configuration of the selection control unit in the head unit.
FIG. 7 is a diagram which illustrates decoding contents of a decoder in the head unit.

FIG. 6 is a diagram which illustrates a configuration of the selection control unit 210 in FIG. 2.

As illustrated in the figure, the clock signal Sck, the data signal Data, and the control signals LAT and CH are supplied to the selection control unit 210 from the control unit 10. A group of a shift register (S/R) 212, a latch circuit 214, and a decoder 216 is provided in the selection control unit 210, by corresponding to respective piezoelectric elements 60 (nozzle 651).

When forming one dot of an image, the data signal Data regulates a size of the dot. According to the embodiment, the data signal Data is configured of two bits of a high-order bit (MSB) and a low-order bit (LSB), in order to express four gradations of non-recording, a small dot, a medium dot, and a large dot.

The data signal Data is supplied to each nozzle from the control section 100 in series, in accordance with main scanning of the head unit 20, in synchronization with the clock signal Sck. The shift register 212 is configured so as to temporarily hold two bits of the data signal Data which are supplied in series, corresponding to nozzles.

In detail, it is a configuration in which the shift registers 212 with the number of stages corresponding to the piezoelectric element 60 (nozzle) are vertically connected to each other, and the data signal Data which is supplied in series is sequentially transmitted to the rear stage according to the clock signal Sck.

When the number of piezoelectric elements 60 is set to m (m is plural number), in order to distinguish the shift register 212, the shift register is denoted by the first stage, the second stage, . . . , the mth stage in order, from the upstream side on which the data signal Data is supplied.

The latch circuit 214 latches the data signal Data which is held in the shift register 212 using rising of the control signal LAT.

The decoder 216 decodes the data signal Data of two bits which is latched by the latch circuit 214, outputs selection signals Sa and Sb in each period of T1 and T2 which is regulated by the control signal LAT and the control signal CH, and regulates a selection in the selecting unit 230.

FIG. 7 is a diagram which illustrates decoding contents in the decoder 216.

In the figure, the latched printing data Data of two bits are denoted by MSB and LSB. When the latched printing data Data is (0, 1), for example, it means that the decoder 216 sets logic levels of the selection signals Sa and Sb to an H level and an L level, respectively, in the period T1, and to the L level and the H level, respectively, in the period T2, and outputs thereof.

The logic level of the selection signals Sa and Sb is level-shifted to logic with high amplitude using a level shifter (not illustrated), compared to logic levels of the clock signal Sck, the printing data Data, and the control signals LAT and CH.

Figure 8:
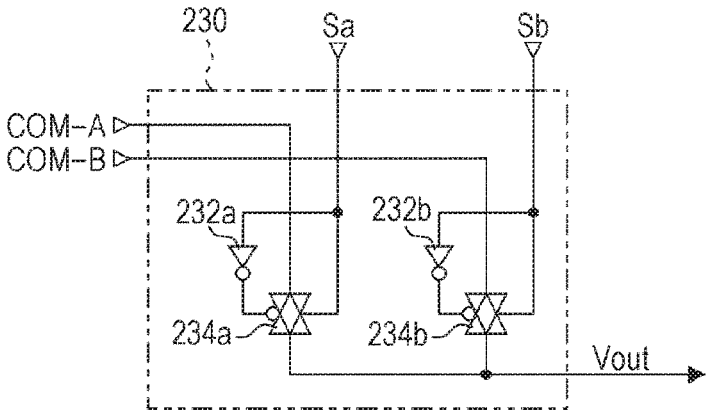
FIG. 8 is a diagram which illustrates a configuration of a selecting unit in the head unit.

FIG. 8 is a diagram which illustrates a configuration of the selecting unit 230 corresponding to one piezoelectric element 60 (nozzle 651) in FIG. 2.

As illustrated in the figure, the selecting unit 230 includes inverters (NOT circuit) 232*a* and 232*b*, and transfer gates 234*a* and 234*b*.

The selection signal Sa from the decoder 216 is supplied to a positive control end of the transfer gate 234*a* to which a circle is not attached, and meanwhile, is supplied to a negative control end of the transfer gate 234*a* to which a circle is attached by being subjected to a logical inversion using the inverter 232*a*. Similarly, the selection signal Sb is supplied to a positive control end of the transfer gate 234*b*, and meanwhile, is supplied to a negative control end of the transfer gate 234*b* by being subjected to a logical inversion using the inverter 232*b*.

The driving signal COM-A is supplied to an input end of the transfer gate 234*a*, and the driving signal COM-B is supplied to an input end of the transfer gate 234*b*. Output ends of the transfer gates 234*a* and 234*b* are commonly connected, and are connected to one end of a corresponding piezoelectric element 60.

The transfer gate 234*a* causes the input end and the output end to be electrically connected (ON) therebetween, when the selection signal Sa is an H level, and causes the input end and the output end not to be electrically connected (OFF) therebetween, when the selection signal Sa is an L level. Similarly, the transfer gate 234*b* also sets the input end and the output end to ON/OFF therebetween, according to the selection signal Sb.

Subsequently, operations of the selection control unit 210 and the selecting unit 230 will be described with reference to FIG. 5.

The data signal Data is supplied in series to each nozzle from the control section 100, in synchronization with the clock signal Sck, and is sequentially transmitted in the shift registers 212 corresponding to the nozzle. In addition, when the control section 100 stops supplying of the clock signal Sck, it enters a state in which the data signal Data corresponding to the nozzle is held in the respective shift registers 212. The data signal Data is supplied in sequential order corresponding to the last stage m, . . . , the second stage, the first stage in the shift register 212.

Here, when the control signal LAT rises, the respective latch circuits 214 simultaneously latch the data signals Data stored in the shift register 212. In FIG. 5, L1, L2, . . . , Lm denote data signals Data which are obtained by latching the data signal Data using the latch circuit 214 corresponding to the shift registers 212 of the first stage, the second stage, . . . , the mth stage.

The decoder 216 outputs the selection signals Sa, and a logic level of Sa using contents which are illustrated in FIG. 7, in respective periods T1 and T2, according to a size of a dot which is regulated by the latched data signal Data.

That is, first, in a case in which the data signal Data is (1, 1), and a size of a large dot is regulated, the decoder 216 sets the selection signals Sa and Sb to an H level and an L level in the period T1, and to the H level and the L level also in the period T2. Secondly, in a case in which the data signal Data is (0, 1), and a size of a medium dot is regulated, the decoder 216 sets the selection signals Sa and Sb to the H level and the L level in the period T1, and to the L level and the H level in the period T2. Thirdly, in a case in which the data signal Data is (1, 0), and a size of a small dot is regulated, the decoder 216 sets the selection signals Sa and Sb to the L level and the L level in the period T1, and to the L level and the H level in the period T2. Fourthly, in a case in which the data signal Data is (0, 0), and non-recording is regulated, the decoder 216 sets the selection signals Sa and Sb to the L level and the H level in the period T1, and to the L level and the L level in the period T2.

Figure 9:
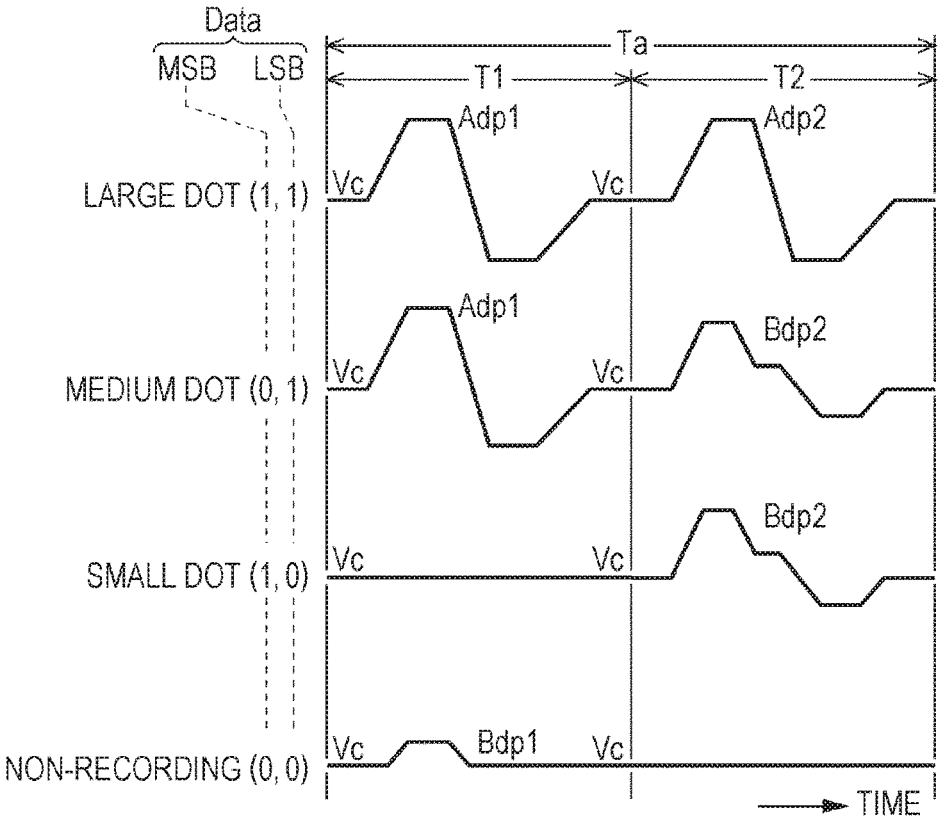
FIG. 9 is a diagram which illustrates a driving signal which is selected by the selecting unit.

FIG. 9 is a diagram which illustrates a voltage waveform of a driving signal which is selected according to the data signal Data, and is supplied to one end of the piezoelectric element 60.

Since the selection signals Sa and Sb become the H level and the L level in the period T1 when the data signal Data is (1, 1), the transfer gate 234*a* is turned on, and the transfer gate 234*b* is turned off. For this reason, the trapezoidal waveform Adp1 of the driving signal COM-A is selected in the period T1. Since the selection signals Sa and Sb become the H level and the L level also in the period T2, the selecting unit 230 selects the trapezoidal waveform Adp2 of the driving signal COM-A.

In this manner, when the trapezoidal waveform Adp1 is selected in the period T1, the trapezoidal waveform Adp2 is selected in the period T2, and the trapezoidal waveforms are supplied to one end of the piezoelectric element 60 as driving signals, ink of a moderate amount is ejected from a nozzle 651 corresponding to the piezoelectric element 60 in twice. For this reason, respective ink land on the medium P, are united, and as a result, a large dot as regulated by the data signal Data is formed.

Since the selection signals Sa and Sb become the H level and the L level in the period T1 when the data signal Data is (0, 1), the transfer gate 234*a* is turned on, and the transfer gate 234*b* is turned off. For this reason, the trapezoidal waveform Adp1 of the driving signal COM-A is selected in the period T1. Subsequently, since the selection signals Sa and Sb become the L level and the H level in the period T2, the trapezoidal waveform Bdp2 of the driving signal COM-B is selected.

Accordingly, ink of a moderate amount and a small amount are ejected in twice from a nozzle. For this reason, respective ink land on the medium P, are united, and as a result, a medium dot is formed, as regulated by the data signal Data.

Since both the selection signals Sa and Sb become the L level in the period T1 when the data signal Data is (1, 0), the transfer gates 234*a* and 234*b* are turned off. For this reason, neither the trapezoidal waveform Adp1 nor Bdp1 is selected in the period T1. In a case in which both the transfer gates 234*a* and 234*b* are turned off, a path from a connecting point of output ends of the transfer gates 234*a* and 234*b* to one end of the piezoelectric element 60 enters an high impedance state of not being electrically connected to any portion. However, the piezoelectric element 60 holds a voltage ($Vc-V_{BS}$) which is obtained immediately before the transfer gate is turned off, due to its own capacity.

Subsequently, since the selection signals Sa and Sb become the L level and the H level in the period T2, the trapezoidal waveform Bdp2 of the driving signal COM-B is selected. For this reason, since ink of a small amount is ejected only in the period T2 from the nozzle 651, a small dot is formed on the medium P as regulated by the data signal Data.

Since the selection signals Sa and Sb become the L level and the H level in the period T1 when the data signal Data is (0, 0), the transfer gate 234*a* is turned off, and the transfer gate 234*b* is turned on. For this reason, the trapezoidal waveform Bdp1 of the driving signal COM-B is selected in the period T1. Subsequently, since both the selection signals Sa and Sb become the L level in the period T2, neither the trapezoidal waveform Adp2 nor Bdp2 B is selected.

For this reason, since ink in the vicinity of the opening hole portion of the nozzle 651 minutely vibrates, and is not ejected in the period T1, as a result, a dot is not formed. That is, it becomes non-recording as regulated by the data signal Data.

In this manner, the selecting unit 230 selects (or does not select) the driving signal COM-A or COM-B according to an instruction of the selection control unit 210, and supplies the driving signal to one end of the piezoelectric element 60. For this reason, each piezoelectric element 60 is driven according to a size of a dot which is regulated by the data signal Data.

The driving signals COM-A and COM-B which are illustrated in FIG. 5 are merely examples. In practice, a combination of various waveforms which are prepared in advance is used according to a movement speed of the head unit 20, a property of the medium P, or the like.

Here, an example in which the piezoelectric element 60 bends upward along with an increase in voltage has been described; however, when a voltage supplied to the electrodes 611 and 612 is reversed, the piezoelectric element 60 bends downward along with an increase in voltage. For this reason, in a configuration in which the piezoelectric element 60 bends downward along with an increase in voltage, the driving signals COM-A and COM-B illustrated in the figure have waveforms which are reversed based on the voltage Vc.

In this manner, according to the embodiment, one dot is formed on the medium P in a unit of the cycle Ta which is a unit period. For this reason, in the embodiment in which one dot is formed, using ejecting of ink droplets of two times (at maximum) in the cycle Ta, the ink ejecting frequency f becomes 2/Ta, and the dot interval D becomes a value obtained by dividing the movement speed v of the head unit by the ink ejecting frequency f (=2/Ta).

In general, in a case in which it is possible to eject ink droplets Q (Q is integer of 2 or more) times in a unit period T, and one dot is formed, using ejecting of ink droplets of the Q times, it is possible to denote the ink ejecting frequency f by Q/T.

As in the embodiment, it is necessary to set a time for ejecting ink droplets one time to be short, even when a time for forming one dot (cycle) is the same, in a case of forming dots of different sizes on the medium P, and a case of forming one dot using ejecting of ink droplets of one time.

Special descriptions for the third method in which two or more dots are formed without combining two or more ink droplets may not be necessary.

Subsequently, the driving circuits 50-*a* and 50-*b* will be described. When schematically describing one driving circuit 50-*a*, the driving circuit generates the driving signal COM-A as follows. That is, the driving circuit 50-*a* firstly performs analog conversion with respect to the data dA which is supplied from the control section 100, secondly, feeds back the driving signal COM-A as an output, corrects a deviation between a signal based on the driving signal COM-A (attenuation signal) and a target signal using a high frequency component of the driving signal COM-A, and generates a modulated signal according to the corrected signal, thirdly, generates an amplified-modulated signal by switching a transistor according to the modulated signal, and fourthly, smooths (demodulates) the amplified-modulated signal using a low pass filter, and outputs the smoothed signal as the driving signal COM-A.

The other driving circuit 50-*b* has the same configuration, and only a difference is that the driving signal COM-B is output from the data dB. Therefore, in FIG. 10 below, the driving circuits 50-*a* and 50-*b* are not distinguished, and will be described as the driving circuit 50.

However, data which is input, or a driving signal which is output is denoted by dA (dB), COM-A (COM-B), or the like, and it is denoted that, in a case of the driving circuit 50-*a*, the data dA is input, and the driving signal COM-A is output, and in a case of the driving circuit 50-*b*, the data dB is input, and the driving signal COM-B is output.

Figure 10:
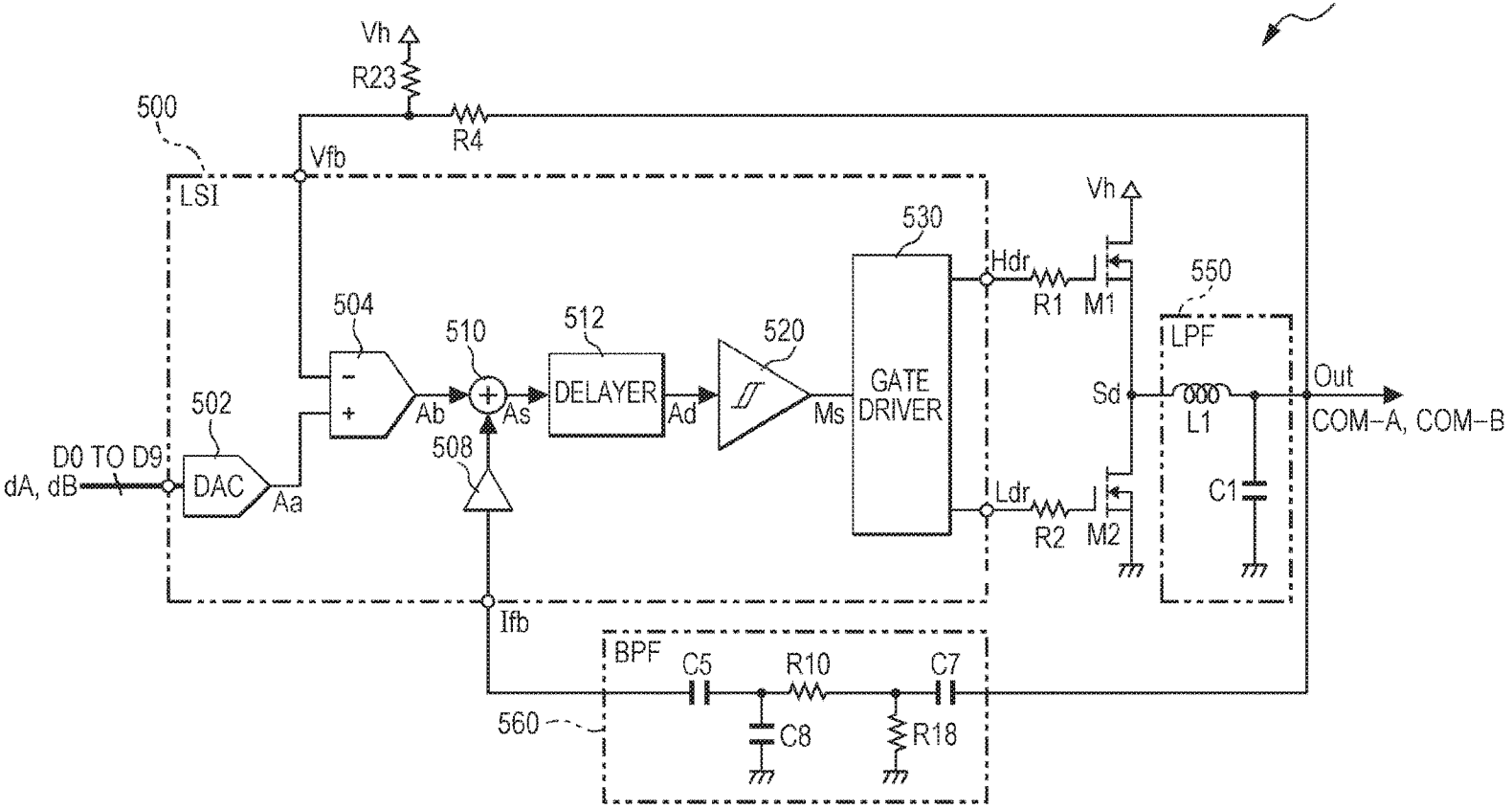
FIG. 10 is a diagram which illustrates a configuration of a driving circuit in the printing apparatus.

FIG. 10 is a diagram which illustrates a circuit configuration of the driving circuit 50.

As illustrated in the figure, the driving circuit 50 is configured of various elements (components) such as a resistor, or a capacitor, in addition to an LSI 500, and N-channel transistors M1 and M2.

The large scale integration (LSI) 500 is a circuit which outputs a gate signal to respective transistor M1 and M2 which is, for example, an N-channel field effect transistor (FET) based on the data dA (dB) of 10 bits which is input from the control section 100 through pins D0 to D9.

In order to output such a gate signal, the LSI 500 includes a digital-to-analog converter (DAC) 502, adders 504 and 510, an attenuator 508, a delayer 512, a comparator 520, and a gate driver 530.

The DAC 502 converts data dA (dB) which regulates a waveform of the driving signal COM-A (COM-B) into an analog signal Aa, and supplies the signal to an input end (+) of the adder 504. A voltage amplitude of the analog signal Aa is approximately 0 V to 2 V, for example, and the driving signal COM-A (COM-B) is obtained by amplifying the voltage approximately 20 times. That is, the analog signal Aa is a source signal as a target of the driving signal COM-A before being amplified.

A voltage of the terminal Out which is input through the pin Vfb, that is, the driving signal COM-A (COM-B) is supplied to an input end (−) of the adder 504.

The adder 504 calculates the voltage of the input end (+), after integrating and attenuating the voltage of the input end (−). In detail, the adder 504 obtains a deviation which is obtained by subtracting the integrated-attenuated voltage of the input end (−) from the voltage of the input end (+), and supplies a signal Ab denoting the deviation to one input end of the adder 510.

In addition, a power supply voltage on a circuit from the DAC 502 to the comparator 520 is, for example, 3.3 V with low amplitude. Since there is a case in which a voltage of the driving signal COM-A exceeds 40 V at maximum, in contrast to the voltage of the analog signal Aa which is approximately 2 V at most, a voltage of the driving signal COM-A (COM-B) is attenuated in order to cause amplitude ranges of both of the voltages to match, when obtaining a deviation.

The attenuator 508 attenuates a high frequency component of the driving signal COM-A (COM-B) which is input through a pin Ifb, and supplies thereof to the other side of the input end of the adder 510. Attenuating by using the attenuator 508 is performed in order to cause voltage amplitude to be matched, when feeding back the driving signal COM-A (COM-B), similarly to the input end (−) in the adder 504. The adder 510 supplies a signal As of a voltage which is obtained by adding a voltage on one side of the input end to a voltage on the other side to the delayer 512.

A voltage of the signal As which is output from the adder 510 is a voltage obtained by adding an attenuated voltage of a signal which is supplied to the pin Ifb to a deviation which is obtained by subtracting an attenuated voltage of a signal supplied to the pin Vfb from a voltage of the analog signal Aa as a target. For this reason, a voltage of the signal As using the adder 510 can be a signal which is obtained by correcting a deviation obtained by subtracting the attenuated voltage of the driving signal COM-A (COM-B) as an output from the voltage of the analog signal Aa as a target using a high frequency component of the driving signal COM-A (COM-B).

The delayer 512 supplies a signal Ad which is obtained by delaying the signal As as much as time which will be described later, to the comparator 520.

The comparator 520 outputs a modulated signal Ms which is subjected to pulse modulation as follows, based on the signal Ad which is delayed by the delayer 512. In detail, the comparator 520 outputs the modulated signal Ms which becomes an H level when the signal Ad becomes a voltage threshold value Vth1 or more, in a voltage rising time, and becomes an L level when the signal Ad becomes less than a voltage threshold value Vth2, in a voltage falling time. As will be described later, the voltage threshold value is set to a relation of Vth1>Vth2.

The modulated signal Ms using the comparator 520 is supplied to the gate driver 530. The gate driver 530 converts the modulated signal Ms into a high-amplitude logic, and supplies thereof to a gate electrode of the transistor M1 through the pin Hdr and the resistor R1, and meanwhile, the gate driver converts a signal obtained by reversing a logic level of the modulated signal Ms into a high-amplitude logic, and supplies thereof to a gate electrode of the transistor M2 through the pin Ldr and the resistor R2.

For this reason, logic levels of the gate signals which are supplied to the gate electrodes of the transistors M1 and M2 are in an exclusive relationship.

In addition, logic levels of two gate signals which are output from the gate driver 530 may be subjected to a timing control so that the logic levels do not become an H level at the same time (that is, so that N-channel transistors M1 and M2 are not turned on at the same time), in practice. For this reason, "exclusive" referred to here means that there is no case of becoming the H level at the same time (transistors M1 and M2 are not turned on at the same time), strictly speaking.

Meanwhile, the modulated signal referred to here is the modulated signal Ms in a narrow sense; however, when being considered as a signal which drives the transistors M1 and M2 by performing pulse modulation according to the signal Aa, the gate signal for the transistor M1 or the gate signal for the transistor M2 is also included in the modulated signal. That is, a signal in which a logic level of the modulated signal Ms is reversed, or a signal which is subjected to a timing control is also included in the modulated signal which is subjected to pulse modulation according to the signal Aa, not only the modulated signal Ms.

Since the comparator 520 outputs the modulated signal Ms, a circuit to the comparator 520, that is, the DAC 502, the adders 504 and 510, the attenuator 508, the delayer 512, and the comparator 520 can be referred to as a modulation circuit which generates the modulated signal Ms.

In the configuration illustrated in FIG. 10, the digital data dA (dB) is converted into the analog signal Aa using the DAC 502; however, the signal Aa may be supplied from an external circuit according to an instruction from the control section 100, for example, not through the DAC 502. Since a target value when generating a waveform of the driving signal COM-A (COM-B) is regulated in both of the data dA (dB) and the analog signal Aa, the signals are surely source signals.

A voltage Vh (for example, 42 V) is applied to a drain electrode in the transistor M1 (high side transistor) on the higher side, in the transistors M1 and M2. A source electrode is grounded in the transistor M2 on the lower side (low side transistor).

Since the respective transistors M1 and M2 are set to the N-channel transistor in this example, the transistors are turned on when the gate signal is an H level. For this reason, the amplified-modulated signal which is obtained by amplifying the modulated signal Ms does not appear at a connecting point Sd between the source electrode of the transistor M1 and the drain electrode of the transistor M2, that is, on one end of the inductor L1. For this reason, the transistors M1 and M2 as a pair of transistors become an amplifier which generates the amplified-modulated signal which is obtained by amplifying the modulated signal Ms.

The other end of the inductor L1 is the terminal Out as an output in the driving circuit 50, and the driving signal COM-A (COM-B) from the terminal Out is supplied to the head unit 20 through the flexible cable 190 (refer to FIGS. 1 and 2).

The terminal Out is connected to one end of the capacitor C1, one end of the capacitor C7, and one end of the resistor R4, respectively. Among these, the other end of the capacitor C1 is grounded. For this reason, the low pass filter (LPF) 550 is configured of the inductor L1, and the capacitor C1, and functions as the demodulator which demodulates the amplified-modulated signal which appears at the connecting point of the transistors M1 and M2 by smoothing thereof.

The other end of the resistor R4 is connected to one ends of the pin Vfb and the resistor R23, and the voltage Vh is applied to the other end of the resistor R23. In this manner, the driving signal COM-A (COM-B) from the terminal Out is pulled up, and is fed back to the pin Vfb.

The resistors R4 and R23 are externally attached to the LSI 500; however, it may be a configuration in which the resistors are built in the LSI 500.

The other end of the capacitor C7 is connected to one end of a resistor R18 and one end of a resistor R10. In these, the other end of the resistor R18 is grounded. For this reason, the capacitor C7 and the resistor R18 function as a high pass filter (HPF) which transmits a high frequency component of a cutoff frequency or more in the driving signal COM-A (COM-B) from the terminal Out. In addition, a cutoff frequency of the HPF is set to approximately 9 MHz, for example.

The other end of the resistor R10 is connected to one end of a capacitor C5 and one end of the capacitor C8. In these, the other end of the capacitor C8 is grounded. For this reason, the resistor R10 and the capacitor C8 function as a low pass filter (LPF) which transmits a low frequency component of the cutoff frequency or less in signal components which pass through the above described HPF. In addition, the cutoff frequency of the LPF is set to approximately 160 MHz, for example.

Since the cutoff frequency of the above described HPF is set to be lower than the cutoff frequency of the above described LPF, HPF and LPF function as a band pass filter (BPF) 560 which causes a frequency component in a predetermined frequency range, in the driving signal COM-A (COM-B) to pass through.

The other end of the capacitor C5 is connected to the pin Ifb of the LSI 500. In this manner, a direct current component in the high frequency component of the driving signal COM-A (COM-B) which passed through the above described BPF is cut off and fed back to the pin Ifb.

The driving circuit 50 includes two paths of a path through the pin Vfb and a path through the pin Ifb are included as the feedback path. In these, a predominant path as a path which regulates a self-oscillating frequency is the path through the pin Ifb. For this reason, in a case of referring to the feedback path, it means a circuit involved with the path through the pin Ifb, and means the LPF 550 and the BPF 560, specifically.

The driving signal COM-A (COM-B) which is output from the terminal Out is a signal obtained by smoothing the amplified-modulated signal in the connecting point Sd of the transistors M1 and M2 using the LPF 550. The driving signal COM-A (COM-B) is fed back to the adder 504 through the pin Vfb, and is output as the signal Ab which is a deviation between the signal and the signal Aa as the target.

Here, when assuming a configuration in which feedback through the pin Ifb, and delay using the delayer 512 are excluded, for ease of descriptions, since the driving signal COM-A (COM-B) is fed back to the adder 504 after being integrated and attenuated through the pin Vfb, the modulated signal Ms is self-oscillated, using a frequency which is determined by a transfer function of a path which passes through the feedback path, that is, the LPF 550 and the adder 504.

However, since a delay amount of the feedback path through the pin Vfb is large, it is not possible to set the frequency for self-oscillating to be high so as to sufficiently secure a waveform accuracy of the driving signal COM-A (COM-B) with only the feedback through the pin Vfb.

Therefore, according to the embodiment, it is set so that delay in the entire circuit is reduced, by providing a path to which a high frequency component of the driving signal COM-A (COM-B) is fed back through the pin Ifb, separately from the path through the pin Vfb. For this reason, a frequency of the signal As which is obtained by adding a high frequency component of the driving signal COM-A (COM-B) to the signal Ab becomes high compared to a case in which the path through the pin Ifb is not present (that is, self-oscillating frequency becomes high), and a waveform accuracy is increased by reducing a ripple component in the driving signal COM-A (COM-B).

Figure 11:
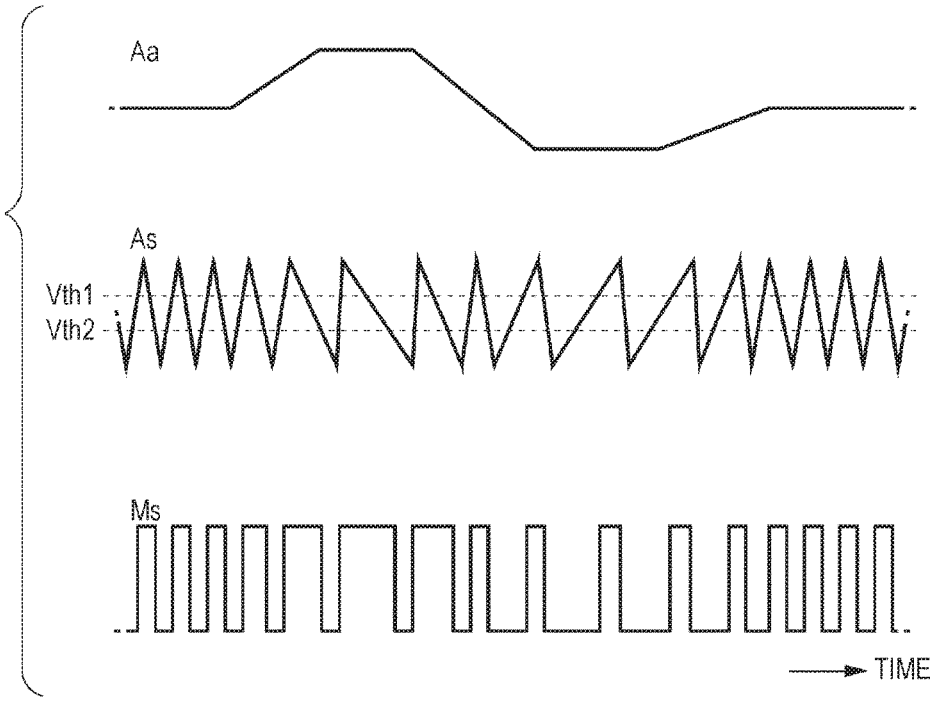
FIG. 11 is a diagram which describes operations of the driving circuit.

FIG. 11 is a diagram which illustrates an ideal relationship between the signal As and the modulated signal Ms with respect to a waveform of the analog signal Aa.

As illustrated in the figure, the signal As is a triangular wave, and an oscillating frequency thereof fluctuates according to a voltage (input voltage) of the analog signal Aa. Specifically, the oscillating frequency becomes the highest value in a case in which the input voltage is a medium value, or becomes low when the input voltage becomes higher, or lower than the medium value. In addition, the signal As (Ad) is a self-excited oscillation signal.

An inclination of the triangular wave in the signal As is appropriately the same in rising (rising of voltage) and falling (falling of voltage), when the input voltage is close to the medium value. For this reason, a duty ratio of the modulated signal Ms which is a result obtained by comparing the signal As with the voltage threshold values Vth1 and Vth2, using the comparator 520 becomes approximately 50%. When the input voltage becomes higher than the medium value, a falling inclination of the signal As become moderate. For this reason, a period in which the modulated signal Ms becomes the H level is relatively long, and a duty ratio increases. On the other hand, a rising inclination of the signal As becomes moderate when the input voltage becomes lower than the medium value. For this reason, a period in which the modulated signal Ms becomes the L level is relatively short, and a duty ratio decreases.

For this reason, the modulated signal Ms becomes the following pulse density modulation signal. That is, the duty ratio of the modulated signal Ms is approximately 50% when the input voltage is the medium value, increases when the input voltage becomes higher than the medium value, and decrease when the input voltage becomes lower than the medium value.

As described above, the gate driver 530 turns the transistors M1 and M2 on/off based on the modulated signal Ms. That is, the gate driver 530 turns on the transistor M1, and turns off the transistor M2 when the modulated signal Ms is an H level, and on the other hand, turns off the transistor M1, and turns on the transistor M2, when the modulated signal Ms is an L level.

Accordingly, the voltage of the driving signal COM-A (COM-B) which is obtained by smoothing the amplified-modulated signal in the connecting point Sd of the transistors M1 and M2 using the inductor L1 and the capacitor Cl becomes high when a duty ratio of the modulated signal Ms increases, and becomes low when the duty ratio decreases. For this reason, as a result, the driving signal COM-A (COM-B) is controlled so as to be a signal which increases a voltage of the analog signal Aa, and is output.

Since the driving circuit 50 uses a pulse density modulation, there is an advantage that it is possible to obtain a large variation width of the duty ratio, compared to a pulse width modulation in which a modulation frequency is fixed.

That is, since a minimum positive pulse width and negative pulse width which can be treated in the entire circuit are restricted due to circuit characteristics thereof, in a pulse width modulation with a fixed frequency, it is possible to secure only a predetermined range (range from 10% to 90%, for example) as a variation width of the duty ratio. In contrast to this, in the pulse density modulation, since the oscillating frequency decreases when the input voltage is far from the medium value, in a region in which the input voltage is high, it is possible to further increase the duty ratio, and in a region in which the input voltage is low, it is possible to further decrease the duty ratio. For this reason, in the self-excited oscillation-type pulse density modulation, it is possible to secure a wide range (for example, from 5% to 95%) as the variation width of the duty ratio.

The driving circuit 50 is the self-excited oscillation type, and a circuit which generates a carrier wave of a high frequency, like separately-excited oscillation, is not necessary. For this reason, there is an advantage that it is easy to integrate a function which is burdened by a circuit other than a circuit which treats a high voltage, that is, the LSI 500.

The driving circuit 50 has a configuration in which various elements such as the LSI, the capacitor, and the resistor are mounted on the circuit board. Therefore, subsequently, a method of disposing and mounting elements which configure the driving circuit 50, and a circuit board on which the elements are disposed and mounted will be described.

Figure 12:
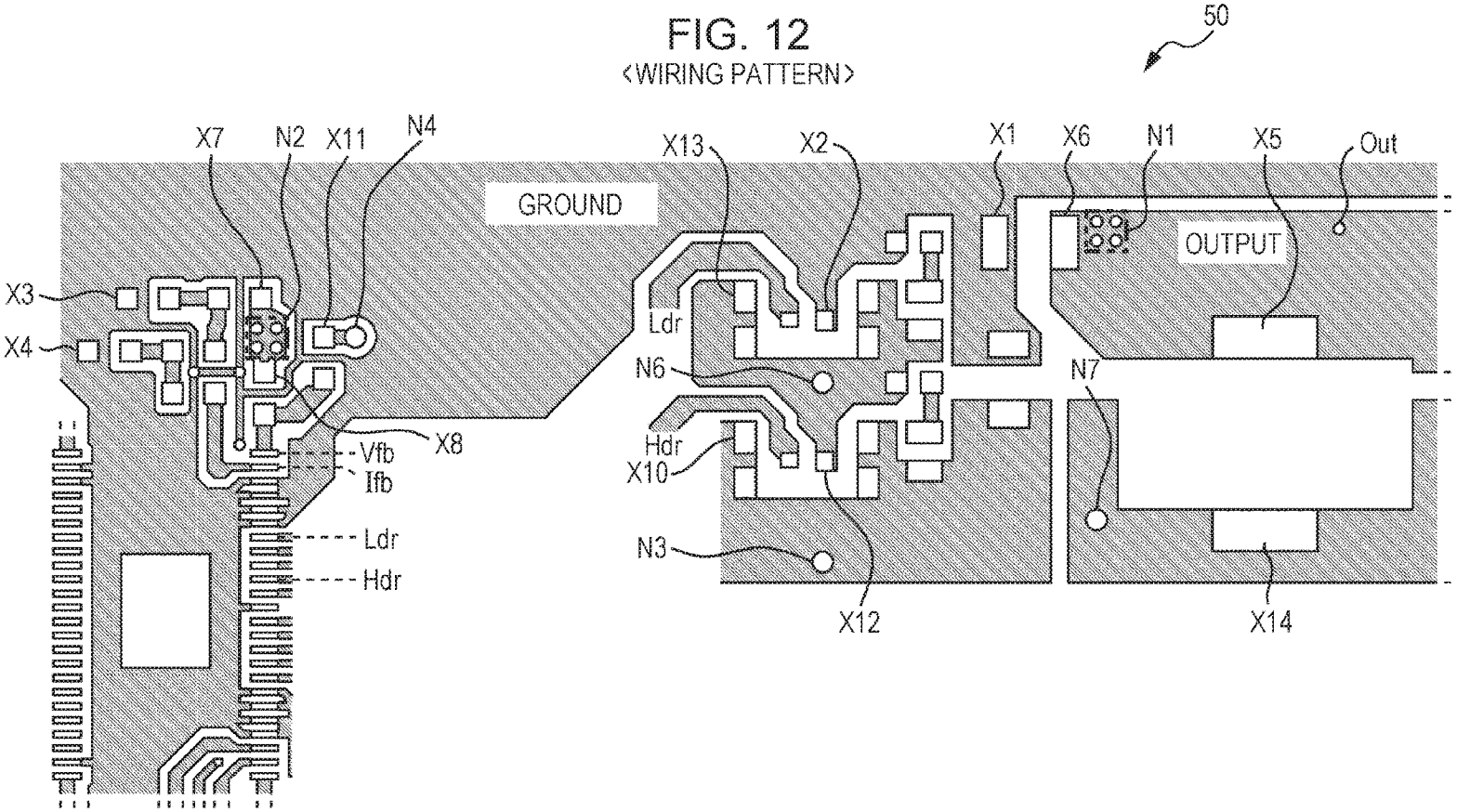
FIG. 12 is a plan view which illustrates a wiring pattern of a circuit board on which the driving circuit is mounted.
Figure 13:
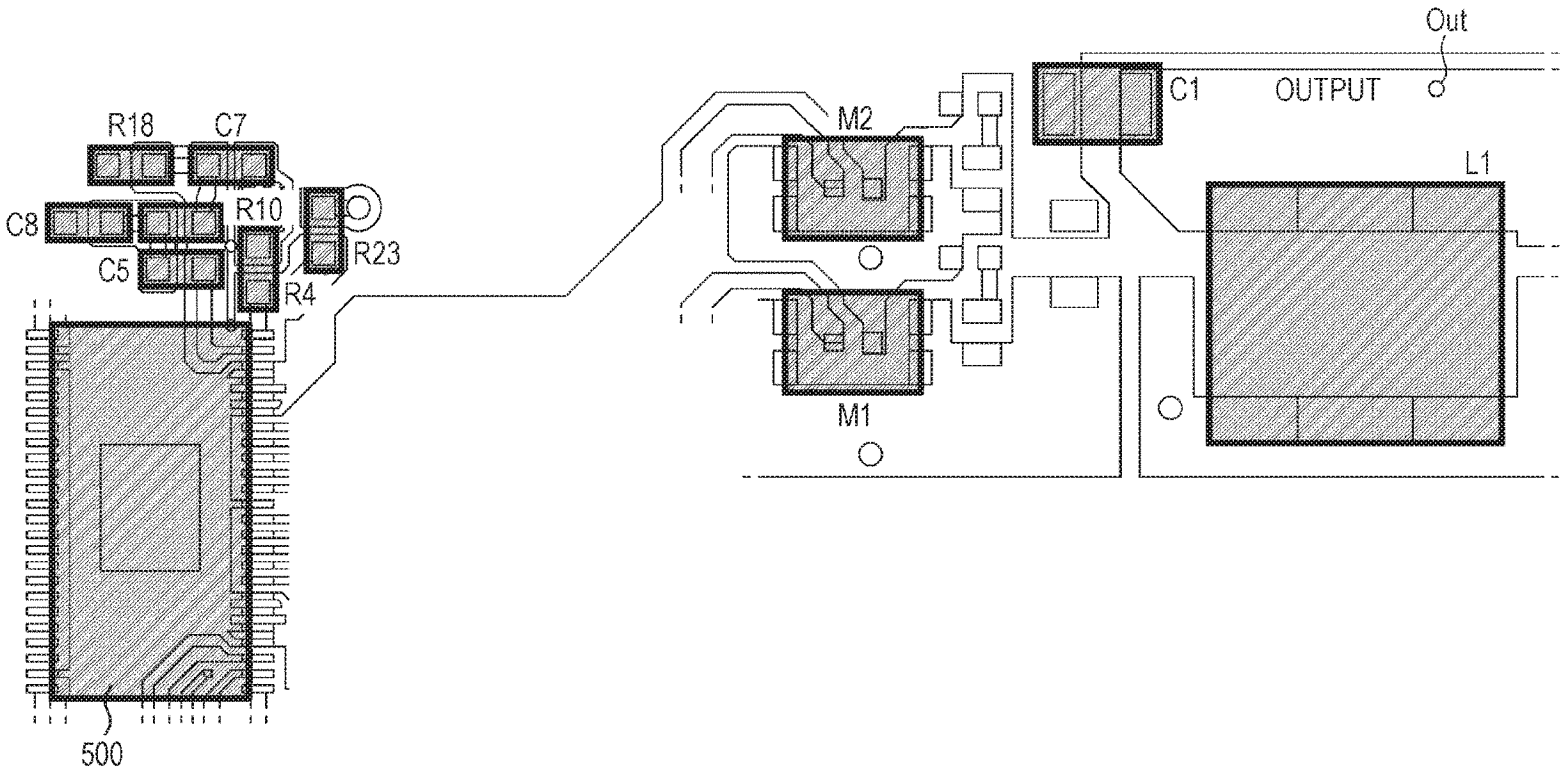
FIG. 13 is a diagram which illustrates disposing of elements which are mounted on the circuit board.

FIG. 12 is a diagram which illustrates a wiring pattern of a circuit board when viewing the circuit board planarly, and FIG. 13 is a diagram which illustrates disposing of the elements which are mounted on the circuit board, using a relationship with the wiring pattern which is illustrated in FIG. 12.

As illustrated in FIG. 13, the LSI 500, the transistors M1 and M2, the inductor L1, the capacitors C1, C5, C7, and C8, and the resistors R4, R10, R18, and R23 which configure the driving circuit 50 are mounted on the circuit board.

In FIGS. 12 and 13, a gate signal which is output from the pin Hdr of the LSI 500 is supplied to the gate electrode of the transistor M1 through the resistor R1 (omitted in FIGS. 12 and 13). The same is applied to a gate signal which is output from the pin Ldr, and the gate signal is supplied to the gate electrode of the transistor M2 through a resistor R2 (omitted in FIGS. 12 and 13).

A terminal X1 which is connected to the other end of the capacitor C1, a terminal X2 which is connected to a source electrode of the transistor M2, a terminal X3 which is connected to the other end of the resistor R18, and a terminal X4 which is connected to the other end of the capacitor C8 are respectively connected to ground patterns.

In addition, a through hole N1 is provided in a pattern (output terminal Out) which includes a terminal X5 which is connected to the other end of the inductor L1, and a terminal X6 which is connected to one end of the capacitor C1. Meanwhile, a through hole N2 is provided in a pattern which includes a terminal X7 which is connected to one end of the capacitor C7, and a terminal X8 which is connected to one end of the resistor R4.

In the circuit diagram in FIG. 10, the driving signal COM-A (COM-B) is divided into two systems from the terminal Out, and is fed back to the pin Vfb and the pin Ifb of the LSI 500; however, in practice, as illustrated in FIG. 12, the driving signal COM-A (COM-B) has a configuration of being branched off to one end of the resistor R4, and one end of the capacitor C7 from the through hole N1 which is provided in the pattern including the terminal Out, through an inserted wiring pattern (not illustrated), and the through hole N2, sequentially. In these, a path on the resistor R4 side is fed back to the pin Vfb, and a path on the capacitor C7 side is fed back to the pin Ifb.

The inserted wiring pattern referred to here is a wiring pattern which is configured except for the first layer, when the wiring pattern illustrated in FIG. 12, that is, the wiring pattern to which various elements are connected is set to the first layer.

A through hole N3 is provided in a pattern which includes a terminal X10 which is connected to a drain electrode of the transistor M1. In addition, a through hole N4 is provided in a pattern which includes a terminal X11 which is connected to the other end of the resistor R23. An insertion pattern (not illustrated) is connected to the through holes N3 and N4, and the voltage Vh is applied thereto, respectively.

A through hole N6 is provided in a pattern (connecting point Sd in FIG. 10) which includes a terminal X12 which is connected to the source electrode of the transistor M1, and a terminal X13 which is connected to the drain electrode of the transistor M2. A through hole N7 is provided in a pattern which includes a terminal X14 which is connected to one end of the inductor L1. The through holes N6 and N7 are electrically connected to each other through the inserted wiring pattern (not illustrated).

Figure 17:
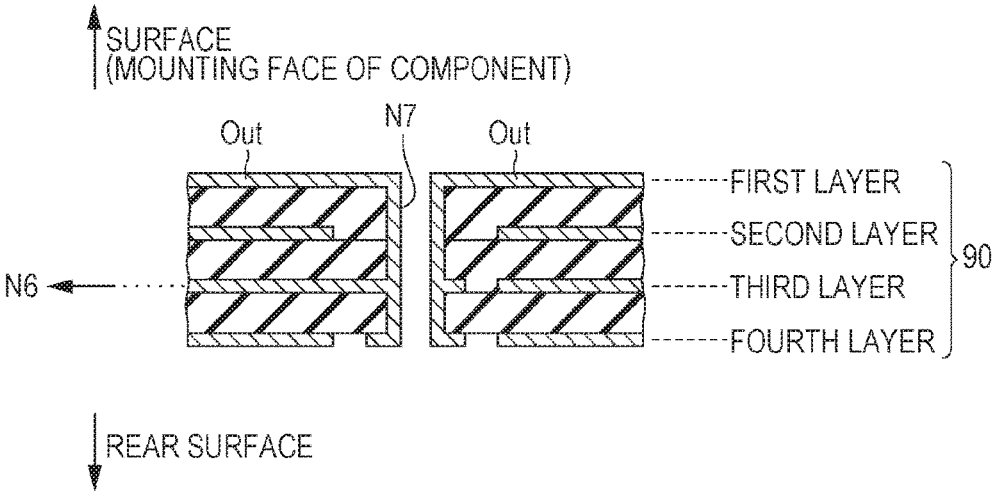
FIG. 17 is a sectional view which illustrates a structure of the circuit board including a through hole.

FIG. 17 is a partial sectional view which illustrates a structure of a circuit board at the periphery of the through hole N7.

A circuit board 90 has a structure in which wiring patterns from the first layer to the fourth layer, and an insulating resin of glass epoxy, or the like, are stacked, for example.

As illustrated in the figure, in the through hole N7, a wiring pattern of the first layer is connected to one end of a wiring pattern which is formed of a wiring pattern of the third layer, and reaches the through hole N6 through a through hole. In addition, since there is no wiring pattern which is connected through the through hole N7 in the second layer and the fourth layer in this example, the second layer and the fourth wiring pattern, that is, the ground wiring pattern, for example, are patterned so as not to be in contact with a penetrating portion of the through hole N1.

Since the inductor L1 is electrically inserted between the connecting point Sd and the terminal Out, a relatively large current flows therein, and the inductor easily generates heat. For this reason, there is a possibility that heat radiating may not sufficient, only by being connected to the wiring pattern in the first layer.

According to the embodiment, since the wiring pattern including the terminal X14 which is connected to one terminal of the inductor L1 is connected to another wiring pattern in the third layer through the through hole N7, it is possible to efficiently radiate heat which is generated in the inductor L1.

Since the wiring pattern including the terminal X5 which is connected to the other terminal of the inductor L1 is connected to a wiring pattern in another layer through the through hole N1, it is possible to efficiently radiate heat which is generated in the inductor L1, similarly.

In addition, as a matter of course, the through hole N7 which is provided in the wiring pattern including the terminal X14 may be provided over a plurality of places, though it is one place in FIG. 12.

Subsequently, the inductor L1 will be described.

In general, an inductor (coil) can be roughly classified into an air core type in which an electric wire is wound in a cylindrical shape, and the inside of the cylinder is set to be empty, and a core type in which a coil is wound around a core. In these, since there is a large loss in the air core type, though it is low distortion, the air core type is not suitable for a demodulator which demodulates an amplified-modulated signal. For this reason, the core type is used in the demodulator in the driving circuit 50.

As a core member in the core type, there are three types of Mn-Zn based ferrite (hereinafter, simply referred to as Mn-Zn system), Ni-Zn based ferrite (hereinafter, simply referred to as Ni-Zn system), and a dust core in general. In the dust core, there is a core in which magnetic powder molded using high pressure pressing is used as a core member. Rs which is a resistance component of a coil becomes different depending on a selection of a core member. Rs is a resistance component of a coil, and includes a resistance component which contributes to an iron loss (core loss), and a resistance component which contributes to a copper loss (loss in wire). Here, as the resistance component, there also is a DC resistance (of approximately 2 mΩ, for example) of the coil; however the DC resistance is sufficiently small (for example, 2 digits) compared to Rs.

An inductor in which the Ni-Zn based core member is used (hereinafter, also referred to as Ni-Zn system, simply) tends to have low saturation magnetic flux density compared to an inductor in which the Mn-Zn based core member (hereinafter, also referred to as Mn-Zn system, simply) is used, or an inductor in which a core member of a dust core (hereinafter, also referred to as dust core, simply) is used. Such a tendency means that it is necessary to increase the number of coils, for example, compared to other inductors, when obtaining a desired inductance value. For this reason, it is improper to apply the Ni-Zn system to the printing apparatus 1 in which miniaturization is strongly needed, and it is preferable to use the Mn-Zn system, or the dust core, when considering saturation magnetic flux density.

In the embodiment, the dust core is used because of the following reason, between the Mn-Zn system and the dust core.

Figure 14A:
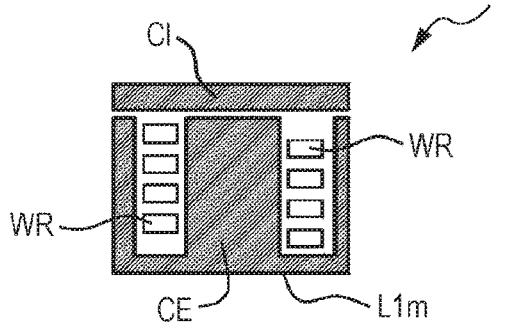
FIG. 14A is a simple sectional view which illustrates a structure of a ferrite core type.

First, as illustrated in FIG. 14A, a general ferrite core (for example, of Mn-Zn system and Ni-Zn system) has a structure in which a coil WR is wound around a core CE with an E-shape section, and the core CE is covered with a core CI formed in an I shape. In the structure, it is necessary to fix the core CI to the core CE using an adhesive, or the like.

Figure 14B:
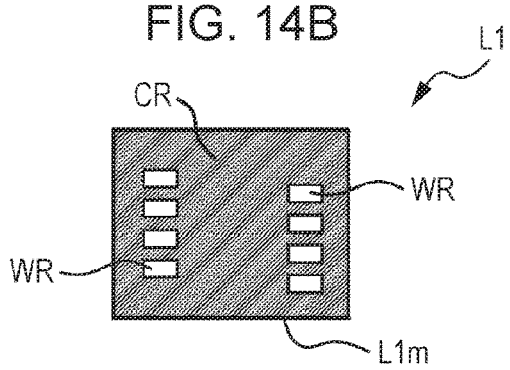
FIG. 14B is a simple sectional view which illustrates a structure of a metal alloy type.

Therefore, according to the embodiment, as the inductor L1, a metal alloy type which is a dust core, and in which magnetic particles of metal alloy are used is adopted. In the metal alloy type, as illustrated in FIG. 14B, a core CR which is made of a mixture of magnetic particles and a binder, and a coil WR are integrally molded. That is, in the metal alloy type, an air-core coil (coil WR) is inserted into a metal mold, a core member which is measured is input thereto, and the metal alloy type is formed, using high pressure pressing.

The core CR is not divided into the E-shaped core CE and the core CI, like the ferrite core, and there is no need of bonding between cores. In addition, the metal alloy type has a wide choice when selecting a core member, is relatively small, and in which it is possible to cause a large current to flow.

Figure 15:
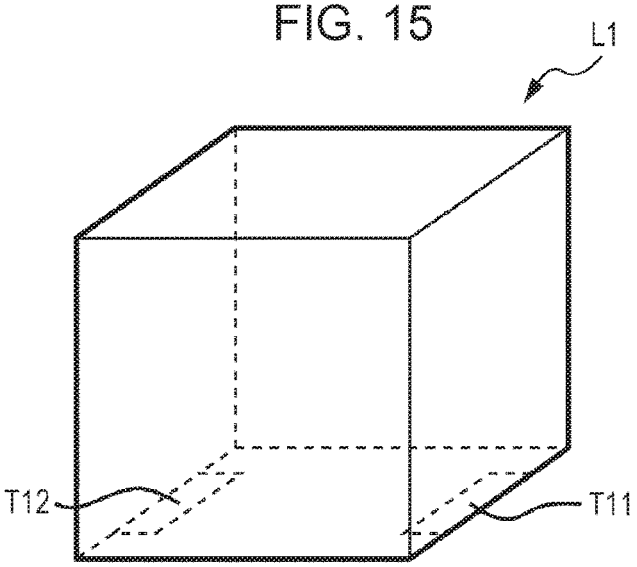
FIG. 15 is a diagram which illustrates an external configuration of an inductor.

FIG. 15 is a diagram which illustrates a shape of the inductor L1 which is mounted on the circuit board.

As illustrated in the figure, the shape of the inductor L1 is approximately a rectangular parallelepiped shape, and a connection terminal T11 which corresponds to one end is provided on one side of two facing sides of a face which is mounted on the circuit board, and a connection terminal T12 which corresponds to the other end is provided on the other side of the two sides, respectively.

Figure 16:
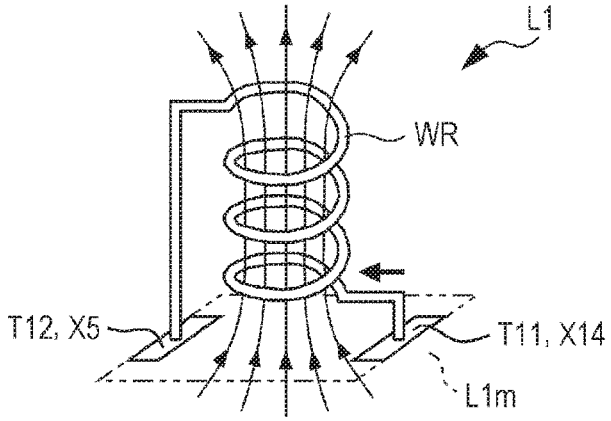
FIG. 16 is a diagram which illustrates a configuration of a coil, or the like, in the inductor.

FIG. 16 is a diagram which illustrates a state of a coil, or the like, in the inductor L1.

As illustrated in the figure, in the inductor L1, the coil WR is wound upward in counterclockwise from the terminal T11, when viewed planarly from the upper part in the figure, and is guided to the terminal T12 from an upper end toward the lower side thereafter. That is, an axial direction of a core around which the coil WR is wound (not illustrated in FIG. 16) is in a positional relationship of being approximately perpendicular to the circuit board. For this reason, when the inductor L1 is mounted on the circuit board, a lot of magnetic lines of force intersect due to leakage flux on a mounting face L1m which faces the circuit board.

In addition, when a type in which an axial direction of the core becomes approximately a direction parallel to the surface of the circuit board is used as the inductor L1, noise due to the leakage flux influences on another component, and a waveform accuracy of a driving signal deteriorates. For this reason, the type is inappropriate for the inductor L1.

Figure 19:
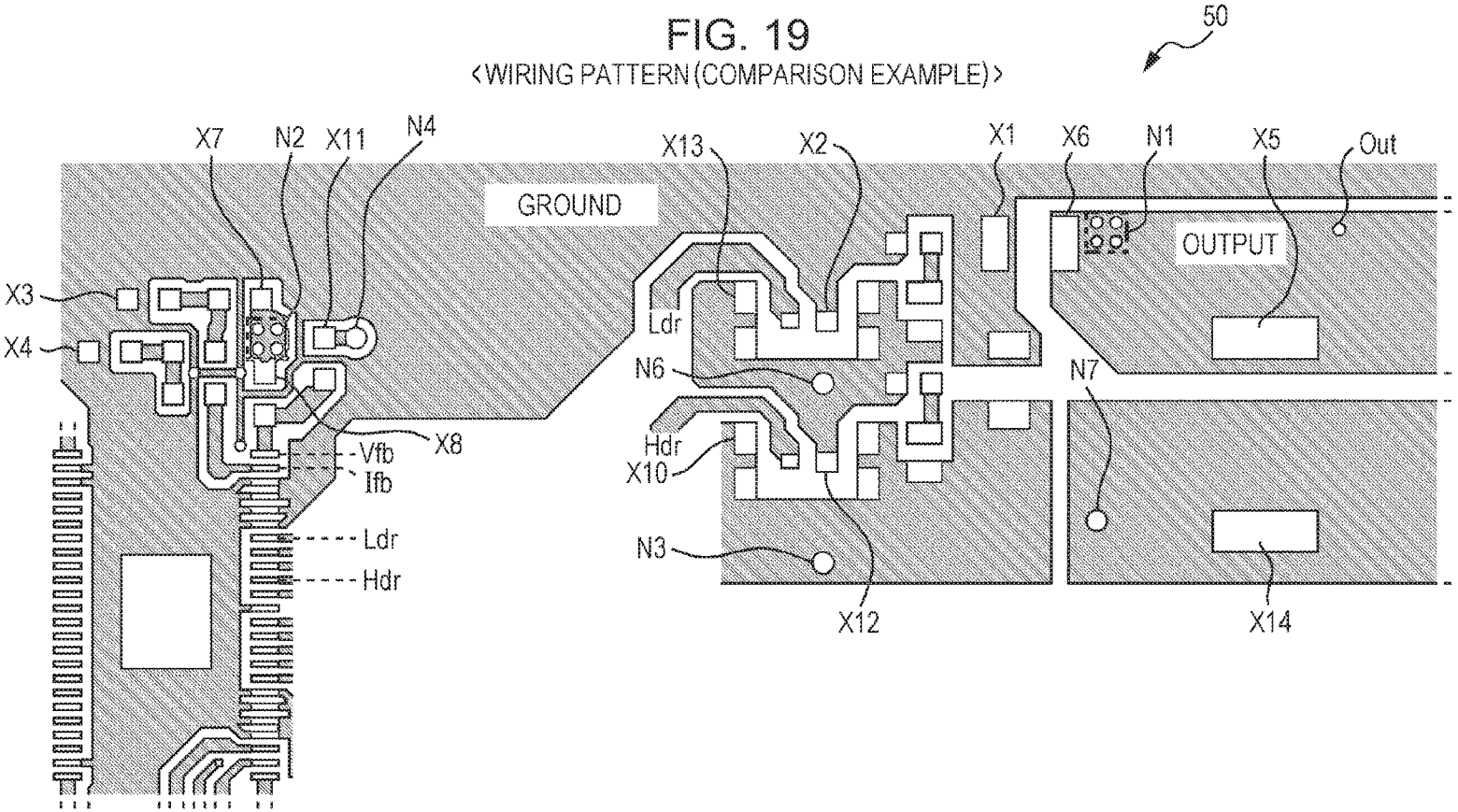
FIG. 19 is a plan view which illustrates a wiring pattern of a circuit board according to a comparison example.
Figure 20:
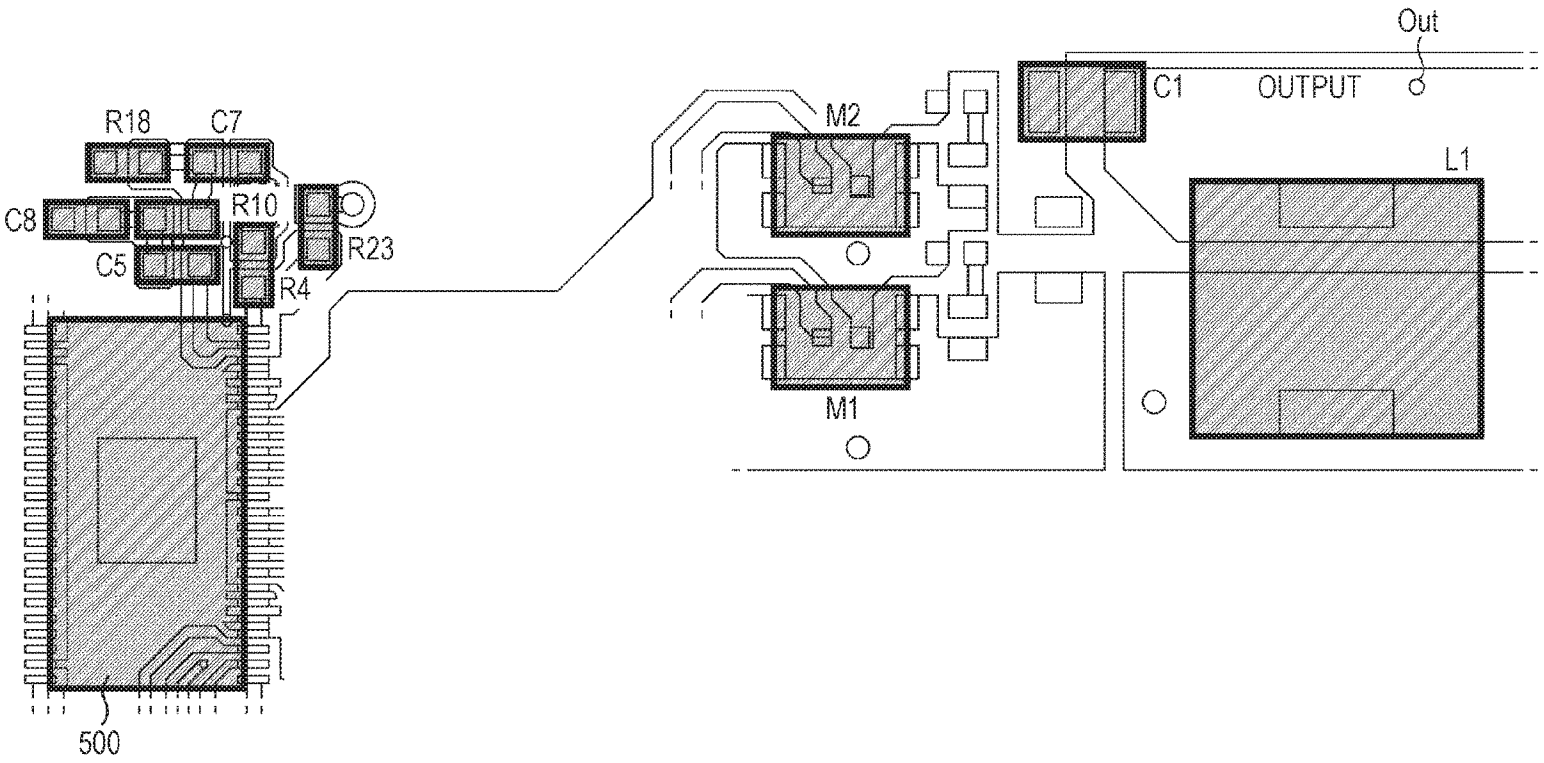
FIG. 20 is a diagram which illustrates disposing of elements which are mounted on the circuit board according to the comparison example.

FIG. 19 is a diagram which illustrates a wiring pattern of a circuit board according to a comparison example, and FIG. 20 is a diagram which illustrates disposing of elements which are mounted on the circuit board.

In the circuit board, when there is a wiring pattern which is illustrated in the comparison example between terminals X14 and X5 (terminals T11 and T12 in inductor L1), an eddy current is generated in the wiring pattern due to the leakage flux of the inductor L1, and it causes a potential of the wiring pattern to fluctuate, not only causing an increase in power consumption by becoming an output loss on the driving circuit 50 side. In particular, since the terminal X5 in the circuit board is an output of the driving circuit 50, and also is two feedback paths, a potential fluctuation due to the eddy current is led to unstableness in self-excited oscillating.

Therefore, in the embodiment, as illustrated in FIGS. 12 and 13, a wiring pattern is not provided between the terminal X14 which is connected to one end of the inductor L1 and the terminal X5 which is connected to the other end, in a region of the circuit board on which the inductor L1 is mounted.

Since it is possible to suppress a generation of an eddy current due to leakage flux from the inductor L1, by not providing a wiring pattern between the terminals X14 and X5 in this manner, there is no useless consumption of power. In addition, since self-excited oscillation is stabilized, it is possible to generate the driving signal COM-A (COM-B) with good accuracy, and reduce erroneous ejecting of ink.

The inductor L1 is mounted on the circuit board 90 using reflow soldering, or the like.

For this reason, as a result, another element is not provided between the core CR which configures the inductor L1 and the circuit board 90.

The invention is not limited to the above described embodiment, and can be subjected to various modifications and applications which will be described below, for example. In addition, in modifications and applications which will be described below, it is also possible to appropriately combine an arbitrarily selected modification or application, or a plurality of modifications or applications.

Figure 18:
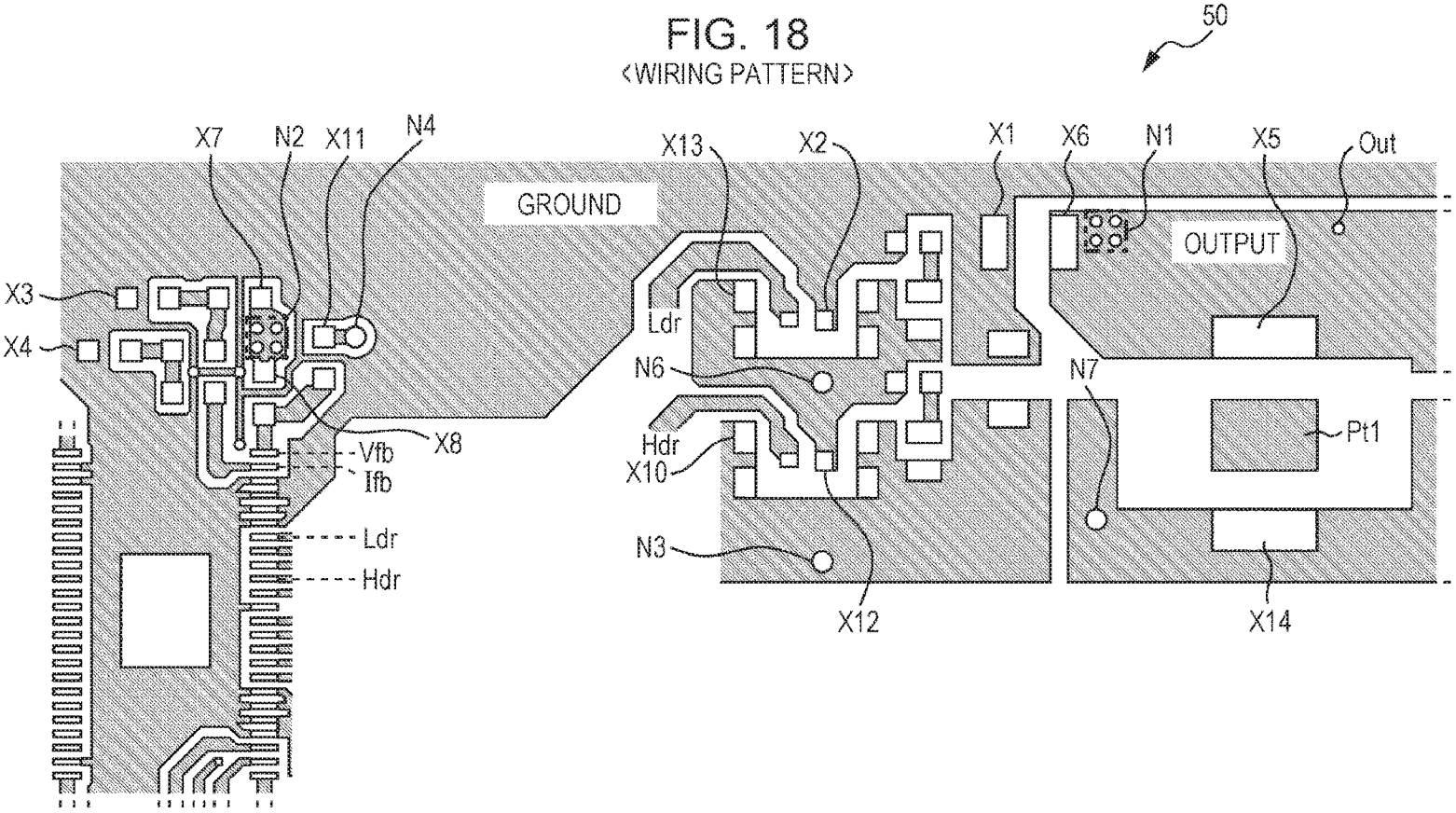
FIG. 18 is a diagram which illustrates a wiring pattern of a circuit board according to another embodiment.

According to the embodiment, a wiring pattern is not provided between the terminal X14 and the terminal X5; however, as illustrated in FIG. 18, a wiring pattern Pt1 may be provided between the terminal X14 and the terminal X5. However, the wiring pattern Pt1 is not connected to the wiring pattern which configures the circuit illustrated in FIG. 10, and is an insular pattern which is electrically inaccessible.

It is also possible to suppress an influence of the leakage flux from the inductor L1, when such a wiring pattern Pt1 is provided.

According to the embodiment, the driving circuit 50 has a configuration in which the driving signal COM-A (COM-B) which is obtained by smoothing the amplified-modulated signal using the LPF 550, when generating the modulated signal Ms; however, the modulated signal Ms itself may be fed back. For example, though it is not particularly illustrated, it may be a configuration in which an error between the modulated signal Ms and the input signal As is calculated, a signal in which the error is delayed and a signal Aa as a target are added or subtracted, and a result thereof is input to the comparator 520.

Since the amplified-modulated signal which appears in the connecting point Sd of the transistors M1 and M2 is different from the modulated signal Ms only in logical amplitude, it may be a configuration in which the amplified-modulated signal is fed back, similarly to the modulated signal Ms, after attenuating the amplified-modulated signal, for example.

In the embodiment illustrated in FIG. 2, it is a configuration in which the number of nozzles is set to be relatively small for ease of descriptions, and the driving signals COM-A and COM-B are respectively output from the two driving circuits 50-*a* and 50-*b*; however, in addition, a driving circuit which outputs driving signals COM-C, COM-D, . . . may be provided, or it may be a configuration in which a plurality of waveforms are provided in a printing period Ta, and these waveforms are selected and output, instead of setting one type of the driving signal COM-A. That is, the number of driving circuits 50 is not limited to "2".

The printing apparatus 1 may be a so-called line printer in which a plurality of head units in which nozzles are arranged in a direction orthogonal or inclined to the sub-scanning direction are provided, and the head units are fixed to a housing, not a type in which ink is ejected while causing the head unit including the plurality of nozzles 651 to reciprocate in the main scanning direction.

According to the embodiment, as a driving target of the driving circuit 50, the piezoelectric element 60 which ejects ink has been exemplified; however, the driving target may be a capacitive load such as an ultrasonic motor, or a touch panel, a planar speaker, a display of liquid crystal, or the like, for example, without being limited to the piezoelectric element 60. That is, the driving circuit 50 may be a circuit which drives such a capacitive load.

What is claimed is:

1. A driving circuit for a capacitive load, the driving circuit comprising:

a demodulator that includes an inductor, the demodulator outputting a signal; and a circuit board on which the demodulator is mounted, a plurality of wiring patterns being formed on the circuit board, the plurality of wiring patterns including first and second wiring patterns, the first wiring pattern and the second wiring pattern being separated from each other, wherein, in the inductor, a coil and a core are integrally formed, the coil and the core are mounted on the circuit board so that an axial direction of the core around which the coil is wound intersects the circuit board, and part of the core is directly exposed to the circuit board, wherein the coil includes first and second coil terminals, the first wiring pattern is electrically connected to the first coil terminal, and the second wiring pattern is electrically connected to the second coil terminal, wherein the first and second wiring patterns are not provided between the coil and the circuit board, and wherein the first and second wiring patterns are not provided between the core and the circuit board.

2. The driving circuit for a capacitive load according to claim 1, wherein the circuit board includes a first board terminal that is electrically connected to the first coil terminal, and the circuit board includes a second board terminal that is electrically connected to the second coil terminal, and wherein the plurality of wiring patterns are not formed between the first board terminal and the second board terminal.

3. The driving circuit for a capacitive load according to claim 2, wherein a through hole is formed in at least one of a wiring pattern of the plurality of wiring patterns that is connected to the first board terminal and a wiring pattern of the plurality of wiring patterns that is connected to the second board terminal.

4. The driving circuit for a capacitive load according to claim 1, wherein components other than the core and the circuit board are not provided between the core and the circuit board.

5. The driving circuit for a capacitive load according to claim 1, further comprising:

a modulation circuit configured to generate a modulated signal obtained by performing pulse modulation with respect to a driving source signal, wherein a frequency of the modulated signal is 1 MHz or more and 8 MHz or less.

* * * * *